US011939184B2

(12) United States Patent
Jenkins et al.

(10) Patent No.: US 11,939,184 B2
(45) Date of Patent: Mar. 26, 2024

(54) SPOOL ASSEMBLY AND METHOD OF ASSEMBLY

(71) Applicant: Scientific Anglers LLC, Midland, MI (US)

(72) Inventors: Joshua Herbert Jenkins, Midland, MI (US); Jeffrey Nelson Noble, Rockford, MI (US)

(73) Assignee: Scientific Anglers LLC, Midland, MI (US)

( * ) Notice: Subject to any disclaimer, the term of this patent is extended or adjusted under 35 U.S.C. 154(b) by 322 days.

(21) Appl. No.: 17/518,137

(22) Filed: Nov. 3, 2021

(65) Prior Publication Data

US 2022/0144579 A1 May 12, 2022

Related U.S. Application Data

(60) Provisional application No. 63/163,248, filed on Mar. 19, 2021, provisional application No. 63/113,592, filed on Nov. 13, 2020, provisional application No. 63/111,465, filed on Nov. 9, 2020.

(51) Int. Cl.
*B65H 54/12* (2006.01)
*B65H 49/32* (2006.01)

(52) U.S. Cl.
CPC ..... *B65H 54/12* (2013.01); *B65H 49/321* (2013.01); *B65H 49/325* (2013.01)

(58) Field of Classification Search
CPC ..... B65H 49/321; B65H 75/2236; B65H 2701/5112; B65H 75/2209
See application file for complete search history.

(56) References Cited

U.S. PATENT DOCUMENTS 811,898 A * 2/1906 Billstein ..... B65D 59/04 206/226
811,899 A * 2/1906 Billstein ..... B65H 75/2209 242/610.2
1,036,643 A * 8/1912 Kilmer et al. ..... B65H 75/2209 206/397
1,205,906 A * 11/1916 Kuehn ..... B65H 75/14 242/118.7
2,112,209 A 3/1938 Goldsmith
2,369,958 A * 2/1945 Fox ..... B65D 85/672 242/118.7

(Continued)

OTHER PUBLICATIONS

European Patent Application No. 21206146.9; Extended Search Report; dated Mar. 17, 2022; 9 pages.

*Primary Examiner* — William A. Rivera
(74) *Attorney, Agent, or Firm* — BakerHostetler

(57) ABSTRACT

A spool configured to support a roll of material. The spool comprises an arbor, a first flange, and a second flange. The first flange includes a first plurality of flange panels that are rotatably connected to respective arbor panels of the arbor at a first arbor edge of the arbor. The second flange is connected to a second arbor edge of the arbor. The first flange is configured to transition between a retention configuration and an open configuration. In the retention configuration, the roll of material is substantially prevented from removal from the arbor along an arbor axis by the first and second flanges. In the open configuration, the roll of material is removable from the arbor and receivable on the arbor in the arbor direction.

20 Claims, 28 Drawing Sheets

(56) References Cited

U.S. PATENT DOCUMENTS

| | | | | | |
|---|---|---|---|---|---|
| 2,852,206 | A * | 9/1958 | Bolding | B65H 75/2209 | 242/118.8 |
| 3,101,846 | A * | 8/1963 | Eifrid | B65D 85/672 | D8/358 |
| 3,104,077 | A * | 9/1963 | Struble | B65H 75/2209 | D8/358 |
| 3,284,022 | A * | 11/1966 | Eifrid | B65H 75/2209 | 242/607.1 |
| 3,384,140 | A * | 5/1968 | Brothers | B65H 75/2209 | D8/358 |
| 3,554,460 | A | 1/1971 | Reas | | |
| 3,817,475 | A * | 6/1974 | Goldstein | B65H 75/229 | 242/118.8 |
| 4,492,350 | A * | 1/1985 | Dgetluck | B65H 75/14 | 242/118.8 |
| 5,513,819 | A * | 5/1996 | Orange | B65H 75/2209 | 242/610.2 |
| 5,649,677 | A * | 7/1997 | Culp | B65H 75/2209 | 242/607.1 |
| 2010/0243790 | A1 | 9/2010 | Ates | | |
| 2012/0234960 | A1 * | 9/2012 | Woods | B65H 75/2209 | 493/309 |

* cited by examiner

SPOOL ASSEMBLY AND METHOD OF ASSEMBLY

CROSS-REFERENCE TO RELATED APPLICATIONS

This application claims benefit to U.S. Provisional Application No. 63/163,248 filed Mar. 19, 2021 and U.S. Provisional Application No. 63/113,592 filed Nov. 13, 2020 and U.S. Provisional Application No. 63/111,465 filed Nov. 9, 2020, the disclosures of which are herein incorporated by reference in their entireties.

TECHNICAL FIELD

This disclosure relates generally to a spool packaging assembly, more particularly, a paperboard spool configured to transition between a retention position and an open position.

BACKGROUND

Filament products can be supplied to end users on storage spools. The filament product can include new filaments and/or existing filaments that are going to be left on a reel for any length of time. The storage spool can protect the filament product during shipping, handling, and general use.

With conventional storage spools, there are two commonly used methods for supplying the filament product. The filament is either directly wound onto the spool, or the filament is wound into a loose coil and placed onto the spool. Typically, fly fishing lines are packaged based on the latter method. The spool includes an arbor for supporting the filament and two flanges for retaining the filament on the arbor. To allow the loose coil to be placed onto the arbor, the spool can be separated into at least two parts, and the flanges can be separated from one another to allow the coil to be placed on the arbor. Enough clearance must be provided between the internal diameter of the coil and the outside diameter of the arbor of the spool to allow the coil to be loaded onto the arbor. However, multiple part spools have drawbacks. For example, there is a potential to pinch the filament between mating surfaces of the spool parts, which can ruin the filament product. Further, the multiple parts can inadvertently separate while in use at high speeds causing tangling, bending, or other damage to the filament. Also, many conventional storage spools are made of plastic, and are discarded after the filament has been dispensed.

The foregoing background discussion is intended solely to aid the reader. It is not intended to limit the innovations described herein. Thus, the foregoing discussion should not be taken to indicate that any particular element of a prior system is unsuitable for use with the innovations described herein, nor is it intended to indicate that any element is essential in implementing the innovations described herein.

SUMMARY

The foregoing needs are met, to a great extent, by the spool assembly disclosed in the present application. There is a global push to reduce single use plastic products. The spool assembly disclosed herein comprises a single piece paperboard spool that is eco-friendly and solves the short comings of the multiple piece spool designs.

An aspect of the present disclosure provides a spool for supporting a roll of material. The spool comprises an arbor, a first flange, and a second flange. The arbor extends about an arbor axis and includes a plurality of arbor panels connected to each other and spaced about the arbor axis. The first and second arbor panels of the plurality of arbor panels each include a first arbor edge, and a third arbor panel of the plurality of arbor panels includes a second arbor edge. The first arbor edges of the first and second arbor panels are spaced from the second arbor edge of the third panel in an arbor direction, which is substantially parallel to the arbor axis.

The first flange includes a first plurality of flange panels. A first flange panel of the first plurality of flange panels is rotatably connected to the first arbor edge of the first arbor panel, and a second flange panel of the first plurality of flange panels is rotatably connected to the first arbor edge of the second arbor panel. The second flange is connected to the second arbor edge of the third arbor panel.

The first flange is configured to transition between a retention configuration and an open configuration. In the retention configuration, the first and second flange panels of the first plurality of flange panels extend from the respective first arbor edges to a retention height. In the open configuration, the first and second flange panels of the first plurality of flange panels extend from the respective first arbor edges to an open height. The retention height and the open height extend in a flange direction from the arbor axis. The flange direction is substantially perpendicular to the arbor axis. The retention height is greater than the open height such that in the retention configuration, the roll of material is substantially prevented from removal from the arbor along the arbor axis by the first and second flanges, and in the open configuration, the roll of material is removable from the arbor in the arbor direction.

Another aspect of the present disclosure provides a method of assembling a paperboard spool from a one-piece paperboard blank. The method comprises: connecting a first arbor panel of a plurality of arbor panels to a second arbor panel of the plurality of arbor panels, wherein the first and second arbor panels form at least a portion of an arbor that extends about an arbor axis; forming a first flange panel crease line between the first arbor panel and a first flange panel of a first plurality of flange panels such that the first flange panel is rotatable relative to the first arbor panel; and forming a second flange panel crease line between the second arbor panel and a second flange panel of the first plurality of flange panels such that the second flange panel is rotatable relative to the second arbor panel.

The first plurality of flange panels compose a first flange that is configured to transition between a retention configuration and an open configuration. In the retention configuration, the first and second flange panels of the first plurality of flange panels extend from the respective first and second arbor edges to a retention height. In the open configuration, the first and second flange panels of the first plurality of flange panels extend from the respective first and second arbor edges to an open height. The retention height is greater than the open height.

Another aspect of the disclosure provides a spool that holds an item that can be coiled. The spool includes a barrel and spaced flanges. The item to be carried by the spool is disposed on the barrel between the flanges. One of the flanges is collapsible to allow an item that is already coiled to be loaded onto the barrel. In the collapsed condition, the collapsible flange is substantially the same size in cross section as the barrel. In one configuration, the collapsible spool is tapered down in cross section away from the barrel to facilitate loading of the coiled item on the spool.

Another aspect of the disclosure provides a spool that is made from a foldable material such as a paperboard or a polymer board. The spool is provided in the form of a flat blank with fold lines scored, cut, or embossed. The spool is erected and adhesive and interlocking elements are provided to maintain the erected condition. In one configuration, the spool can be partially erected into an intermediate condition where it is flat for convenient storage and shipping. In this configuration, the final erection step does not require additional adhesive to complete the erection of the spool.

Another aspect of the disclosure provides a method for loading a coiled item on a spool which includes the steps of collapsing a flange of the spool to a cross section no larger than the cross section of the barrel, sliding the coiled item over the collapsed flange and onto the barrel, and then unfolding the collapsed flange to its expanded condition where it retains the coiled item on the barrel.

Another aspect of the disclosure provides a method for forming a spool wherein a blank is provided and erected to a generally flat intermediate condition with portions secured by adhesive. Later, after the adhesive is cured, the spool is erected into its erected condition using only interlocking connections that do not require adhesive.

Another aspect of the disclosure provides a paperboard spool for fly fishing line wherein the spool can be erected from a flat blank. The spool includes a barrel formed from four walls. Two flanges project outwardly from the outer perimeter of the barrel. The spool provides a collapsible flange that collapses to a loading condition wherein the collapsed flange is in the form of a pyramidal frustum formed by folding corner webs inwardly. The spool has an intermediate condition during its erection wherein all of the adhesive connections are made and wherein the spool can be placed in a substantially flat condition with the barrel walls being parallel and folded down to be substantially parallel with the flanges.

This summary is provided to introduce a selection of concepts in a simplified form that are further described below in the Detailed Description section. This Summary is not intended to identify key features or essential features of the claimed subject matter, nor is it intended to be used to limit the scope of the claimed subject matter. Furthermore, the claimed subject matter is not constrained to limitations that solve any or all disadvantages noted in any part of this disclosure.

BRIEF DESCRIPTION OF THE DRAWINGS

The foregoing summary, as well as the following detailed description of illustrative embodiments of the present application, will be better understood when read in conjunction with the appended drawings. For the purposes of illustrating the present application, there are shown in the drawings illustrative embodiments of the disclosure. It should be understood, however, that the application is not limited to the precise arrangements and instrumentalities shown. In the drawings.

DETAILED DESCRIPTION

Figure 1:
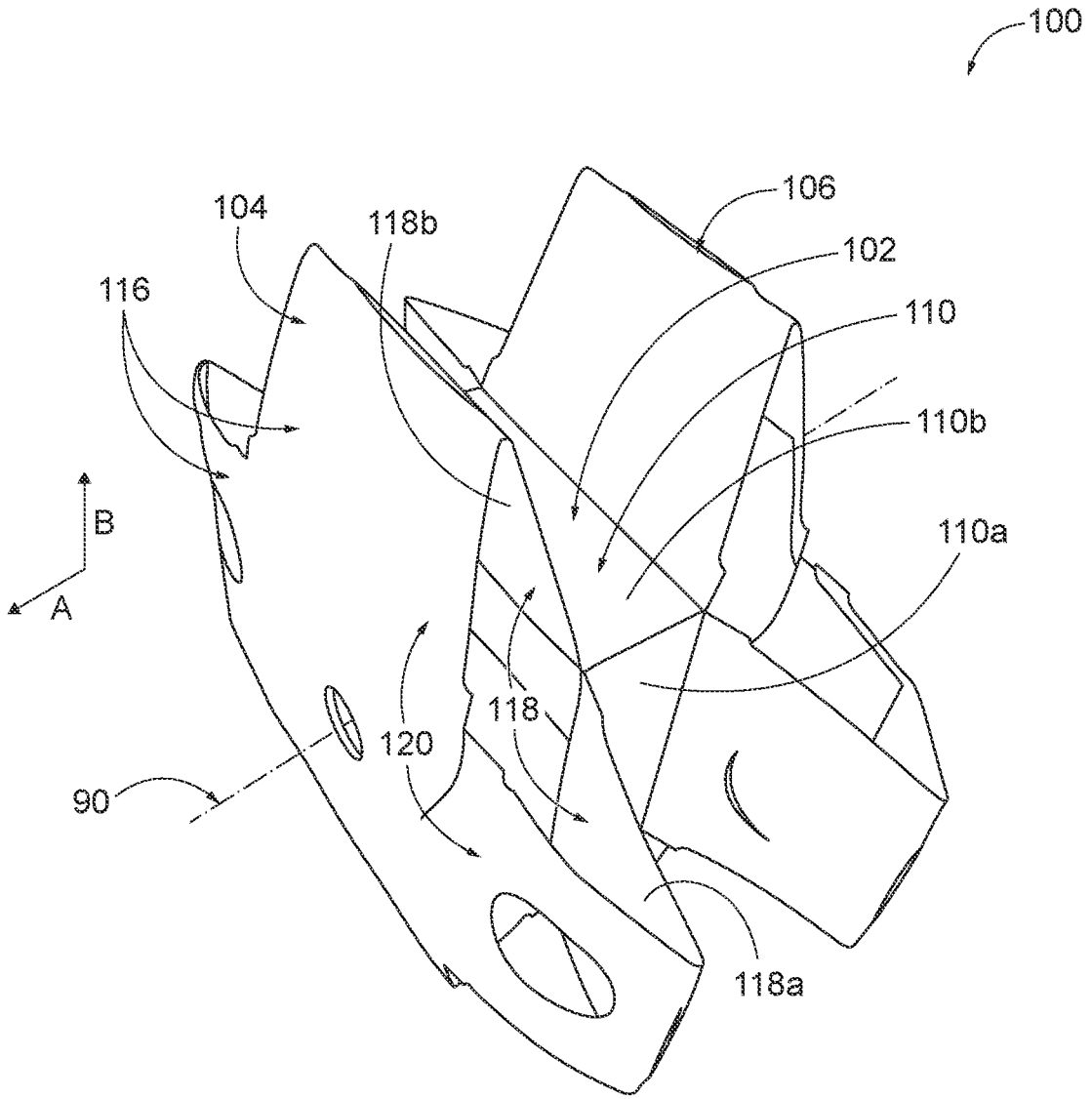
FIG. 1 illustrates a top perspective view of a spool, according to an aspect of this disclosure.

Certain terminology used in this description is for convenience only and is not limiting. The words "axial", "radial", "circumferential", "outward", "inward", "upper," and "lower" designate directions in the drawings to which reference is made. As used herein, the term "substantially" and derivatives thereof, and words of similar import, when used to describe a size, shape, orientation, distance, spatial relationship, or other parameter includes the stated size, shape, orientation, distance, spatial relationship, or other parameter, and can also include a range up to 10% more and up to 10% less than the stated parameter, including 5% more and 5% less, including 3% more and 3% less, including 1% more and 1% less. All ranges disclosed herein are inclusive of the recited endpoint and independently combinable (for example, the range of "from 2 grams to 10 grams" is inclusive of the endpoints, 2 grams and 10 grams, and all the intermediate values). The terminology includes the above-listed words, derivatives thereof and words of similar import.

FIGS. 1 through 6 illustrate a spool 100, according to an aspect of this disclosure. The spool 100 includes an arbor 102, a first flange 104, and a second flange 106. The arbor 102 is configured to support a roll or coil of material 108 thereon. The spool 100 can comprise a paperboard material, which can be folded and bent to form fold lines and/or crease lines spool 100. In an aspect, the spool 100 comprises a single piece of paperboard material. The single piece spool 100 is configured such that one or both of the first and second flanges 104 and 106 can transition between a retention configuration and an open configuration, as further described below. In the retention configuration, the roll of material 108 is retained on the arbor 102 (see FIG. 6). In an open configuration, the roll of material 108 is removable from the arbor 102 (see FIG. 5).

The arbor 102 extends about an arbor axis 90. In an aspect, the arbor axis 90 extends through a radial center of the arbor 102. The arbor 110 includes a plurality of arbor panels 110. Each of the arbor panels 110 is connected to each of the other arbor panels 110 in series. For example, a first arbor panel 110*a* is connected to a second arbor panel 110*b*. In an aspect, the plurality of arbor panels 110 comprises four panels (as illustrated), such that the arbor 102 forms a substantially rectangular cross-sectional shape when viewed along the arbor axis A. It will be appreciated that the arbor 102 can comprise a different number of panels. For example, the arbor 102 can comprise three panels or five or more panels.

Each of the arbor panels 110 includes a first arbor edge 112 and a second arbor edge 114. Each of the first arbor edges 112 is spaced from the respective second arbor edge 114 in an arbor direction A. The arbor direction A is substantially parallel to the arbor axis 90. Each of the arbor panels 110 further includes a third arbor edge 115 and a fourth arbor edge 117. The third arbor edge 115 of an arbor panel 110 is connected to a corresponding fourth arbor edge 117 of an adjacent arbor panel 110. For example, the third arbor edge 115 of the first arbor panel 110*a* is connected to the fourth arbor edge 117 of the second arbor panel 110*b*. Similarly, the third arbor edge 115 of the second arbor panel 110*b* is connected to a fourth arbor edge 117 of a third arbor panel 110*c* (see FIG. 4A).

In an aspect, the third and fourth arbor edges 115 and 117 of each arbor panel 110 extend in a direction substantially parallel to the arbor axis 90. The first, second, third, and fourth arbor edges 112, 114, 115, and 117 can define a substantially rectangular arbor panel 110. In an alternative aspect, the third and fourth arbor edges 115 and 117 are angularly offset from one another (e.g. not substantially parallel to one another), such that each arbor panel 110 includes a trapezoid shape, rhombus shape, combinations thereof, or other quadrilateral shape. In another alternative, each arbor panel 110 can include fewer or more than four arbor edges and can define a triangular shape, hexagon shape, combinations thereof, or other shape. In an aspect, each arbor panel 110 is substantially planar such that each arbor edge (e.g. edges 112, 114, 115, and 117) extends along a substantially similar plane.

The connection between the respective third and fourth arbor edges 115 and 117 of adjacent arbor panels 110 can include a crease line. The crease line can include a fold or bend in the spool 100 material. The crease line can allow each arbor panel 110 to rotate relative to an adjacent arbor panel 100 about the crease line. It will be appreciated that the connection between respective third and fourth arbor edges 115 and 117 can comprise other types of rotatable connections that allow the arbor panels 110 to rotate relative to adjacent arbor panels 110.

The first arbor edge 112 of each arbor panel 110 is rotatably connected to the first flange 104. The rotatable connection between each first arbor edge 112 and the first flange 104 can include a crease line. The crease line can include a fold or bend in the spool 100 material. In an aspect, the first arbor edge 112 of every arbor panel 110 is rotatably connected to the first flange 104. Alternatively, fewer than all the first arbor edges 112 of each arbor panel 110 are connected to the first flange 104. For example, an arbor 102 that includes four arbor panels 110 can have two first arbor edges 112 of two of the arbor panels 110 connected to the first flange 106, while two first arbor edges 112 of two of the other arbor panels 110 are not connected to the first flange 104.

The second arbor edge 114 of each arbor panel 110 is rotatably connected to the second flange 106. The rotatable connection between each second arbor edge 114 and the second flange 106 can include a crease line. The crease line can include a fold or bend in the spool 100 material. In an aspect, the second arbor edge 114 of every arbor panel 110 is rotatably connected to the second flange 106. Alternatively, fewer than all the second arbor edges 114 of each arbor panel 110 are connected to the second flange 104. For example, an arbor 102 that includes four arbor panels 110 can have two second arbor edges 114 of two of the arbor panels 110 connected to the second flange 106, while two second arbor edges 114 of two of the other arbor panels 110 are not connected to the second flange 106.

The connection between the first arbor edges 112 of each arbor panel 110 with the first flange 104 and the connection between the second arbor edges 114 of each arbor panel 110 with the second flange 106 can be substantially symmetric when viewed in a direction substantially perpendicular to the arbor axis 90. For example, each first arbor edge 112 and each second arbor edge 114 can be connected to the respective first flange and second flange 104 and 106 in a substantially similar manner. In an alternative aspect, each arbor panel 110 that has a first arbor edge 112 connected to the first flange 104 has a second arbor edge 114 that is not connected to the second flange 106. And each arbor panel 110 that has a second arbor edge 114 connected to the second flange 106 has a first arbor edge 112 that is not connected to the first flange 104. In this aspect, the first and second flanges 104 and 106 are circumferentially offset from each other when viewed along the arbor axis 90. It will be appreciated that other alternative connections between the arbor panels 110 and the first and second flanges 104 and 106 can be considered that are consistent with the aspects described herein.

The first flange 104 includes a first plurality of flange panels 116. The first plurality of flange panels 116 comprises a first inner plurality of flange panels 118 and a first outer plurality of flange panels 120. The first inner plurality of flange panels 118 extend from the arbor 102 to the first outer plurality of flange panels 120. The first outer plurality of flange panels 120 extend to an end 121 of the first flange 104.

Each of the first arbor edges 112 of the arbor panels 110 is rotatably connected to a respective one of the first inner plurality of flange panels 118. For example, the first arbor panel 110*a* is rotatably connected to a first inner flange panel 118*a*. Similarly, the second arbor panel 110*b* is rotatably connected to a second inner flange panel 118*b*. Each of the first outer plurality of flange panels 120 is rotatably connected to an edge of a respective one of the first inner plurality of flange panels 118. The rotatable connection between each of the panels 110, 118, and 120 can include a crease line formed in the material composing the spool 100.

The rotatable connection between each first arbor edge 112 of the arbor panels 110 and the respective one of the first inner plurality of flange panels 118 can extend in a direction that is substantially perpendicular to the arbor axis 90. Each of the first inner plurality of flange panels 118 can rotate between at least 90 degrees and 180 degrees relative to the respective arbor panel 110 to which the inner flange panel 118 is connected. For example, when one of the first inner plurality of flange panels 118 is rotated approximately 90 degrees relative to the respective arbor panel 110 to which it is connected, the inner flange panel 118 extends in a direction away from (e.g. radially outward) the arbor axis 90 such that the flange panel 118 is substantially perpendicular to the arbor axis 90. When one of the first inner plurality of flange panels 118 is rotated approximately 180 degrees relative to the respective arbor panel 110 to which it is connected, the inner flange panel 118 extends in a direction substantially parallel to the arbor axis 90. In this orientation (e.g. 180 degree rotation), the inner flange panel 118 can be substantially planar with (e.g. align along the same plane) the respective arbor panel 110 to which it is connected. It will be appreciated that each of the first inner plurality of flange panels 118 can rotate to an angle relative to the respective arbor panel 110 to which it is connected that is greater than 180 degrees and less than 90 degrees to facilitate receiving and retaining the roll of material 108 onto the arbor 102, as further described below.

Figure 4A:
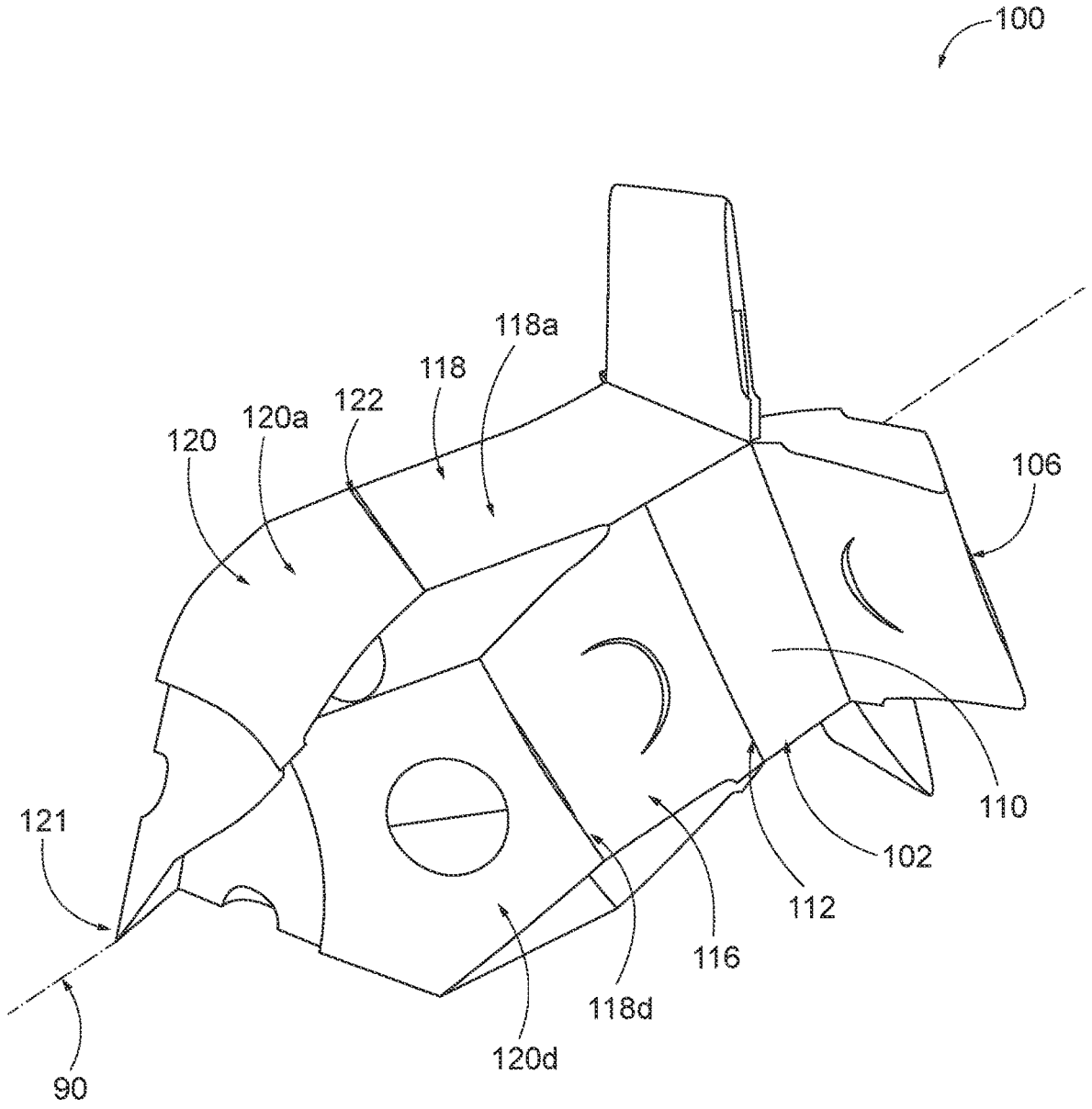
FIG. 4A illustrates a first top perspective view of the spool shown in FIG. 1 in an open configuration.
Figure 4B:
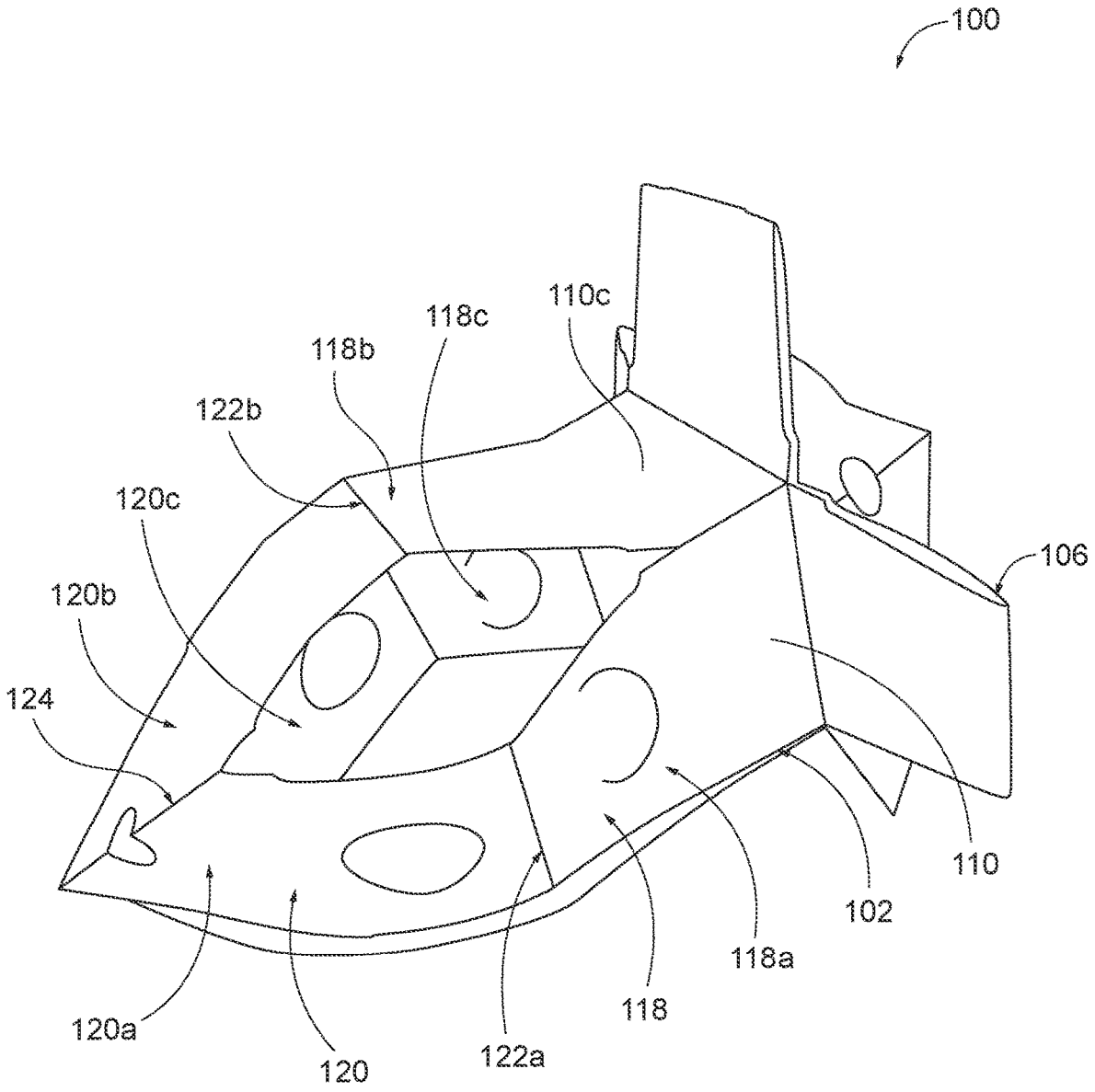
FIG. 4B illustrates a second top perspective view of the spool shown in FIG. 1 in an open configuration.

With reference to FIGS. 4A and 4B, each of the first outer plurality of flange panels 120 is connected to a respective edge 122 of one of the first inner plurality of flange panels 118. Each of the first outer plurality of flange panels 120 is rotatable relative to the respective one of the first inner plurality of flange panels 118 about the edge 122. In an aspect, the edge 122 can be substantially perpendicular to the arbor axis 90. For example, when a first inner flange panel 118*a* of the first inner plurality of flange panels 118 is positioned at 90 degrees relative to the respective arbor panel 110*a*, an edge 122*a* extends substantially perpendicular to the arbor axis 90. It will be appreciated that the edge 122 can extend at other angles other than substantially perpendicular to the arbor axis 90 when the first inner flange panel is greater than 90 degrees. For example, when the first inner flange panel 118*a* is positioned at approximately 180 degrees relative to the respective arbor panel 110, the edge 122*a* can extend at an angle other than substantially perpendicular to the arbor axis 90.

The first plurality of flange panels 116 further includes the second inner flange panel 118*b* and a second outer flange panel 120*b* rotatably connected to the second inner flange panel 118*b* at an edge 122*b*. The second inner flange panel 118*b* can be connected to the second outer flange panel 120*b* in a substantially similar manner as the first inner flange panel 118*a* is connected to the second outer flange panel 120*a* as described above. In an aspect, the first outer flange panel 120*a* is rotatably connected to the second outer flange panel 120*b*. In an aspect, the rotatable connection between the first and second outer flange panels 120*a* and 120*b* is defined by a crease line 124. It will be appreciated that the rotatable connection between the first and second outer flange panels 120*a* and 120*b* can be defined by alternative structures, such as, multiple crease lines 124, flexible panels, combinations thereof, or still other structures. The first and second inner flange panels 118*a* and 118*b* and the first and second outer flange panels 120*a* and 120*b* can be configured such that the first inner flange panel 118*a* and the first outer flange panel 120*a* are mirror images of the second inner flange panel 118*b* and the second outer flange panel 120*b*.

Figure 2:
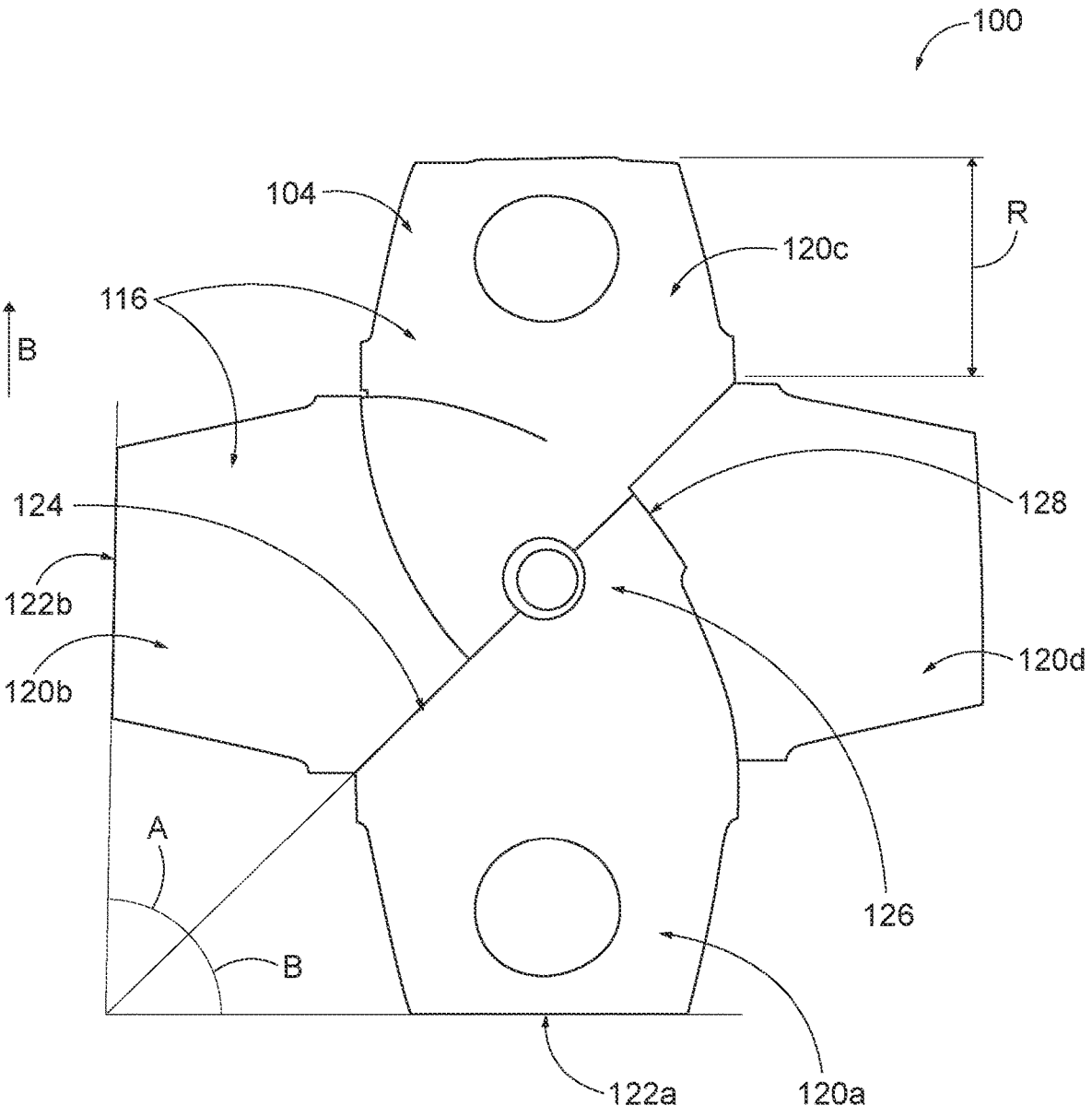
FIG. 2 illustrates a side view the spool shown in FIG. 1.
Figure 3:
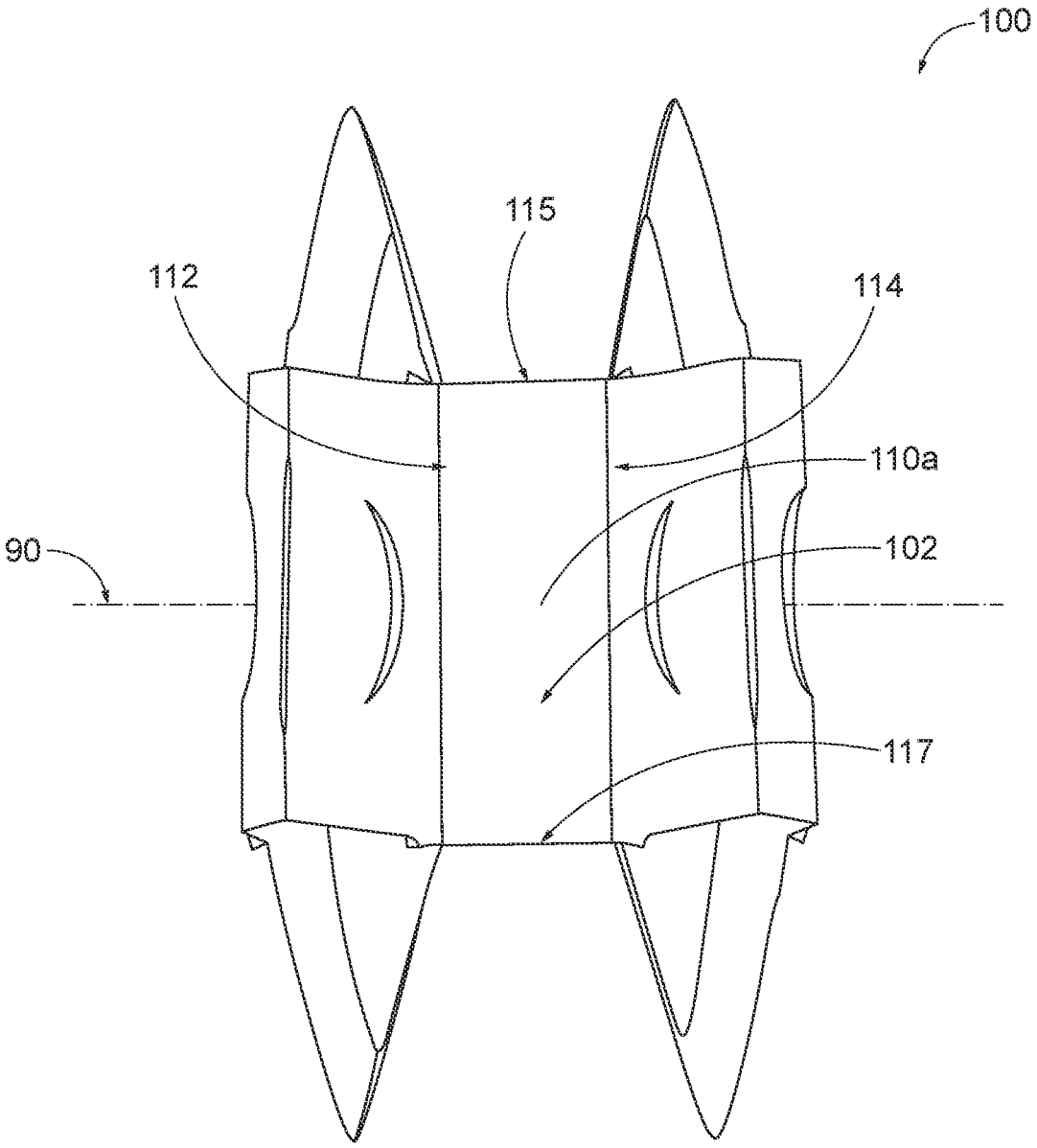
FIG. 3 illustrates a top view of the spool shown in FIG. 1.

With reference to FIG. 2, the rotatable connection between the first and second outer flange panels 120*a* and 120*b* can extend at an angle that is angularly offset from the edges 122*a* and 122*b*. For example, when the first and second outer flange panels 120*a* and 120*b* are aligned such that they both lie on substantially the same plane, the crease line 124 can be angularly offset from the edge 122*a* by an angle A of approximately 45 degrees. Similarly, the crease line 124 can be angularly offset from the edge 122*b* by an angle B of approximately 45 degrees in a direction opposite the angular offset between the edge 122*a* and the crease line 124.

The first plurality of flange panels 116 can further include a third inner flange panel 118*c*, a fourth inner flange panel 118*d*, a third outer flange panel 120*c*, and a fourth outer flange panel 120*d*. The third and fourth inner flange panels 118*c* and 118*d* and the third and fourth outer flange panels 120*c* and 120*d* can be configured substantially similarly to the first and second inner flange panels 118*a* and 118*b* and the first and second outer flange panels 120*a* and 120*b*, respectively. Each of the third and fourth inner flange panels 118*c* and 118*d* can extend from a respective first arbor edge 112 of the arbor. Each of the third and fourth outer flange panels 120*c* and 120*d* can extend from the respective third and fourth inner flange panels 118*c* and 118*d*.

With reference to FIG. 2, the first and second outer flange panels 120*a* and 120*b* can be configured to connect with the third and fourth outer flange panels 120*c* and 120*d*. In an aspect, either or both of the first and second outer flange panels 120*a* and 120*b* can include a first connect element 126. Either or both of the third and fourth outer flange panels 120*c* and 120*d* can include a second connect element 128. The first and second connect elements 126 and 128 are configured to connect to one another to selectively retain the first flange 104 in the retention configuration. The first and second connect elements 126 and 128 can include, for example, Velcro connectors, a protrusion and slot connection, snap connection, or other type of connection to selectively connect the first and second outer flange panels 120*a* and 120*b* with the third and fourth outer flange panels 120*c* and 120*d*.

In an alternative or additional aspect, at least one of the first plurality of inner flange panels 118 can be configured to connect with a respective one of the first plurality of outer flange panels 120. The connection between at least one of the first plurality of inner flange panels 118 and the respective one of the first plurality of outer flange panels 120 can selectively retain the first flange 104 in the retention configuration, as further described below.

Figure 5:
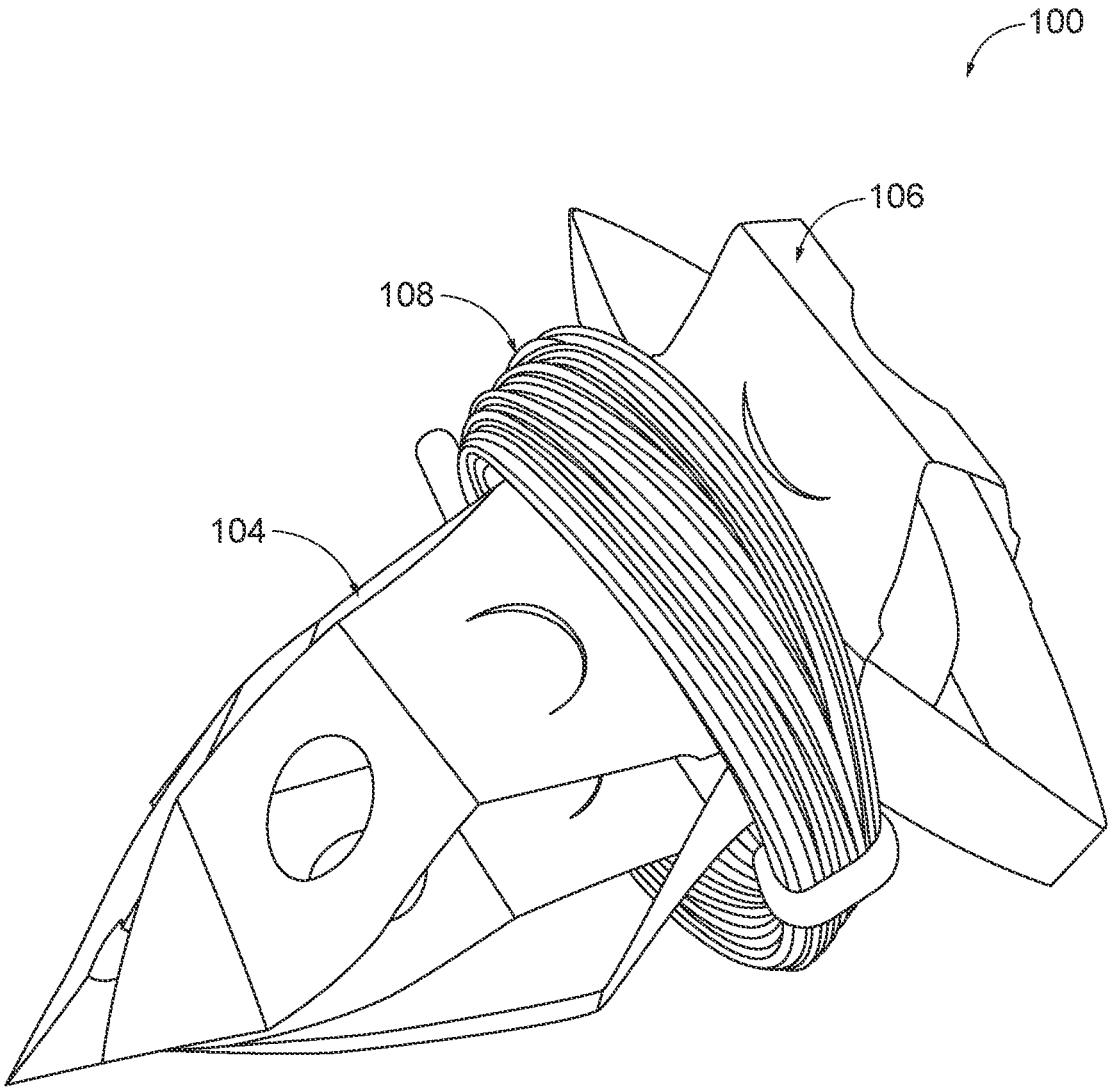
FIG. 5 illustrates a top perspective view of the spool shown in FIG. 1 in an open configuration with a roll of material positioned thereon.

The first flange 104 is configured to transition between the retention configuration (see FIGS. 2 and 6) and the open configuration (see FIGS. 4A, 4B, and 5). In the retention configuration, the first and second inner flange panels 118*a* and 118*b* extend from the respective first arbor edges 112 to a retention height R. In the open configuration, the first and second inner flange panels 118*a* and 118*b* extend from the respective first arbor edges 112 to an open height. The retention height and the open height extend in a flange direction B from the arbor axis 90. The flange direction B is substantially perpendicular to the arbor axis 90.

The retention height is greater than the open height to allow the roll of material 108 to be inserted onto and about the arbor 102 (see FIG. 5). For example, in the open configuration of the first flange 104, an outer cross-sectional dimension of the first plurality of flange panels 116 is less than an inner cross-sectional dimension of the roll of material 108. In the open configuration, at least one of the first inner plurality of flange panels 118 is positioned relative to the respective arbor panel to which it is connected at an angle of less than approximately 90 degrees. In an example, in a fully open position, each of the first inner plurality of flange panels 118 is positioned relative to the respective arbor panel to which it is connected at an angle of approximately 180 degrees. In the open configuration, the roll of material 108 is removable from the arbor 102 in the arbor direction A along the arbor axis 90.

Figure 6:
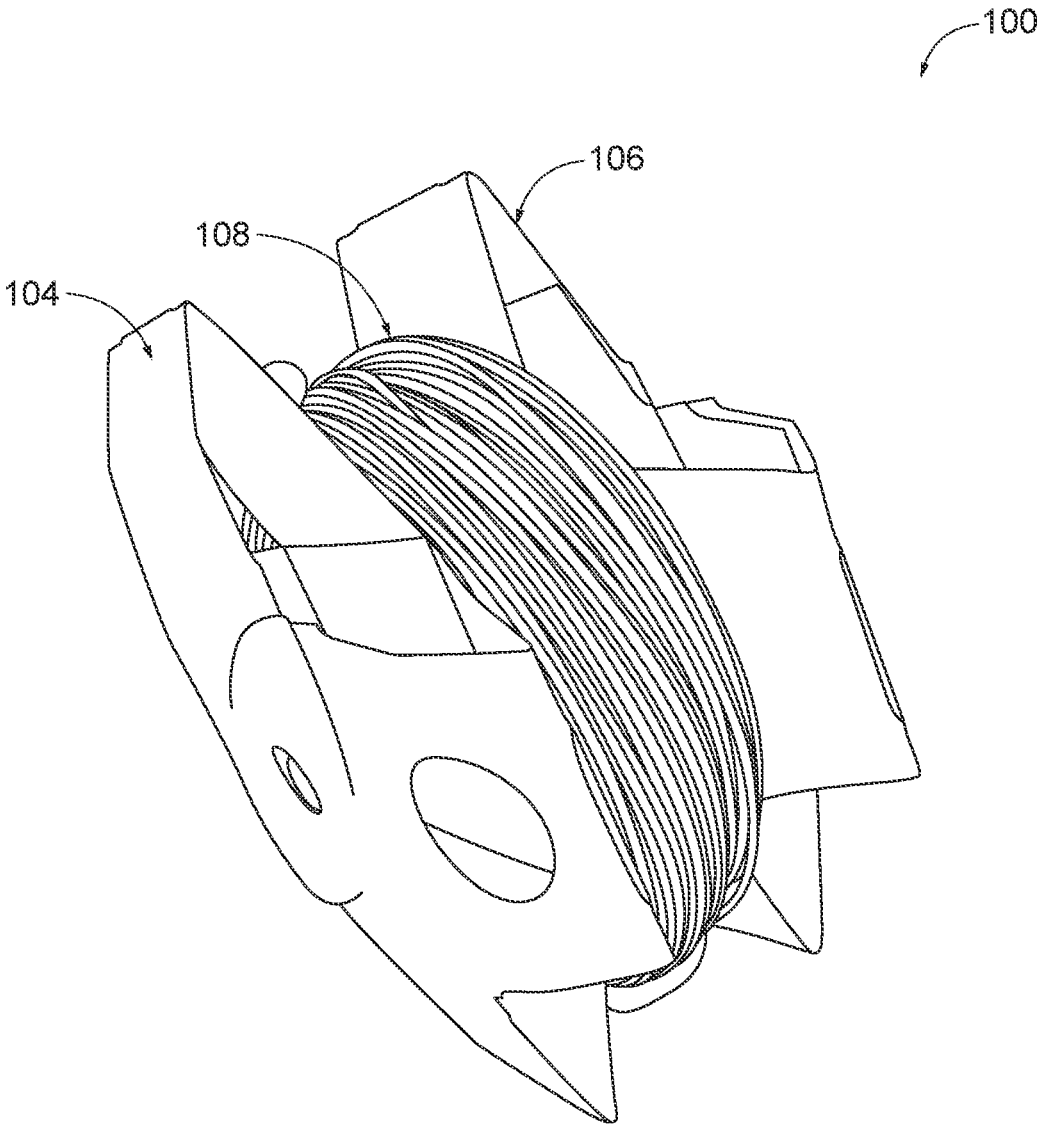
FIG. 6 illustrates a top perspective view of the spool shown in FIG. 1 in a retention configuration with a roll of material positioned thereon.
Figure 7:
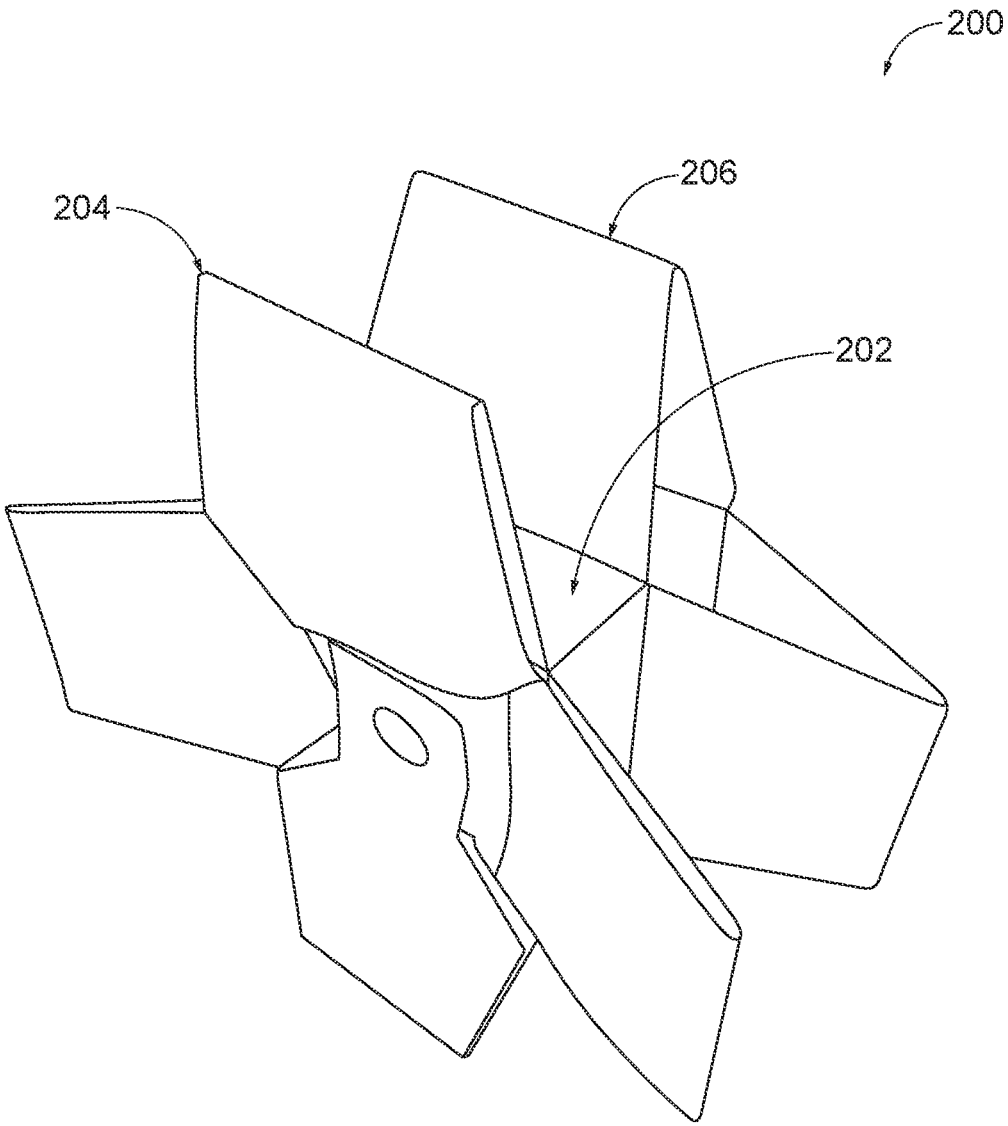
FIG. 7 illustrates a top perspective view of a spool, according to an alternative aspect of this disclosure.

In the retention configuration, the roll of material 108 is substantially prevented from removal from the arbor 102 along the arbor axis 90 by the first and second flanges 104 and 106 (see FIG. 6). For example, in the retention configuration of the first flange 104, an outer cross-sectional dimension of the first plurality of flange panels 116 is greater than an inner cross-sectional dimension of the roll of material 108. In the retention configuration, at least one of the first inner plurality of flange panels 118 is positioned relative to the respective arbor panel to which it is connected at an angle of approximately 90 degrees. It will be appreciated that the roll of material 108 can be retained on the arbor 102 when at least one of the first inner plurality of flange panels 118 is at an angle of less than approximately 90 degrees relative to the arbor panel 110 to which it is connected if the outer cross-sectional dimension of the first inner plurality of flange panels 118 is greater than an inner cross-sectional dimension of the roll of material 108.

The first flange 104 can be transitioned from the retention configuration to the open configuration by rotating one or more of the first plurality of flange panels 116. For example, the first and second inner flange panels 118*a* and 118*b* can be rotated from approximately 90 degrees relative to the respective arbor edge 112 to an angle of greater than approximately 90 degrees. In an aspect, the first and second inner flange panels 118*a* and 118*b* can be rotated to approximately 180 degrees. Rotation of the first and second inner flange panels 118*a* and 118*b* causes the respective first and second outer flange panels 120*a* and 120*b* to rotate about the respective edges 122*a* and 122*b*. As the first and second inner flange panels 118*a* and 118*b* and the first and second outer flange panels 120*a* and 120*b* rotate from 90 degrees toward 180 degrees relative to the arbor 102, the first flange 104 extends axial outward from the arbor 102 in the arbor direction A. When the first and second inner flange panels 118*a* and 118*b* reach the open height, the roll of material can be positioned on the arbor 102 by moving the roll of material along the arbor axis 90.

To transition the first flange from the open configuration to the retention configuration, the first and second inner flange panels 118*a* and 118*b* are rotated toward the 90 degree position relative to the respective arbor panel 110. As the first and second inner flange panels 118*a* and 118*b* and the first and second outer flange panels 120*a* and 120*b* rotate toward 90 degrees relative to the arbor 102, the first flange 104 retracts axially inward toward the arbor 102 in a direction opposite the arbor direction A. After the first and second inner flange panels 118*a* and 118*b* reach the retention height H, the roll of material 108 is retained on the arbor 102.

The first flange 102 can be selectively retained in the retention configuration by connected the first connect element 126 to the second connect element 128. In an aspect, in the retention configuration of the first flange 104, a surface of the first outer flange panel 120*a* abuts against a surface of the first inner flange panel 118*a*, and a surface of the second outer flange panel 120*b* abuts against a surface of the second inner flange panel 118*b*. One or both of the sets of abutting surfaces of the first inner and outer flange panels 118*a* and 120*a* and the second inner and outer flange panels 118*b* and 120*b* can include connect elements (see e.g. FIG. 22—snap feature) to selectively connect the abutting surfaces together. The selective connection between the abutting surfaces can selectively retain the first flange 104 in the retention configuration.

It will be appreciated that the third and fourth inner flange panels 118*c* and 118*d* and the third and fourth outer flange panels 120*c* and 120*d* can be moved and/or transitioned substantially similarly as the first and second inner flange panels 118*a* and 118*b* and the first and second outer flange panels 120*a* and 120*b* to transition the first flange 104 between the retention configuration and the open configuration.

It will be appreciated that the second flange 106 can be configured substantially similarly to the first flange 104. For example, the second flange 106 can include a second plurality of flange panels 132. The second plurality of flange panels 132 can transition the second flange 106 between a retention configuration to retain the roll of material 108 on the arbor 102, and an open configuration to allow the arbor 102 to receive the roll of material 108 and to allow the roll of material 108 to be removed from the arbor 102. It will be appreciated that the first and second flanges 104 and 106 can be configured differently from one another. For example, the second flange 106 can be configured such that the second flange is retained or locked in the retention position. To receive and remove the roll of material 108 from the arbor 102, the first flange 104 is selectively transitioned between the retention and open configurations.

The precise appearance and structure defined by the spool 100 can be modified without departing from the scope of the present disclosure. For example, the connect elements 126 and 128 can be located on different panels of either of the first and second flanges 104 and 106. In another alternative, the spool 100 could have fewer or more inner panels and/or fewer or more outer panels configured to transition between retention and open configurations. In another alternative aspect, each of the outer flange panels 120 can be connected to each adjacent outer flange panel 120.

FIGS. 7 through 13 illustrate a spool 200, according to an alternative aspect of this disclosure. It will be appreciated that the spool 200 can be transitioned, aligned, and configured in a substantially similar manner as the spool 100 described herein. The spool 200 includes an arbor 202, a first flange 204, and a second flange 206. The arbor member 202 and the first and second flanges 204 and 206 can be integrally formed as a single unitary piece. For example, the first and/or the second flange 204 and 106 can transition between an open position and a retention position without removing either the first and the second flange 204 and 206 from the arbor 202. The spool 200 can comprise a paperboard material.

Figure 8:
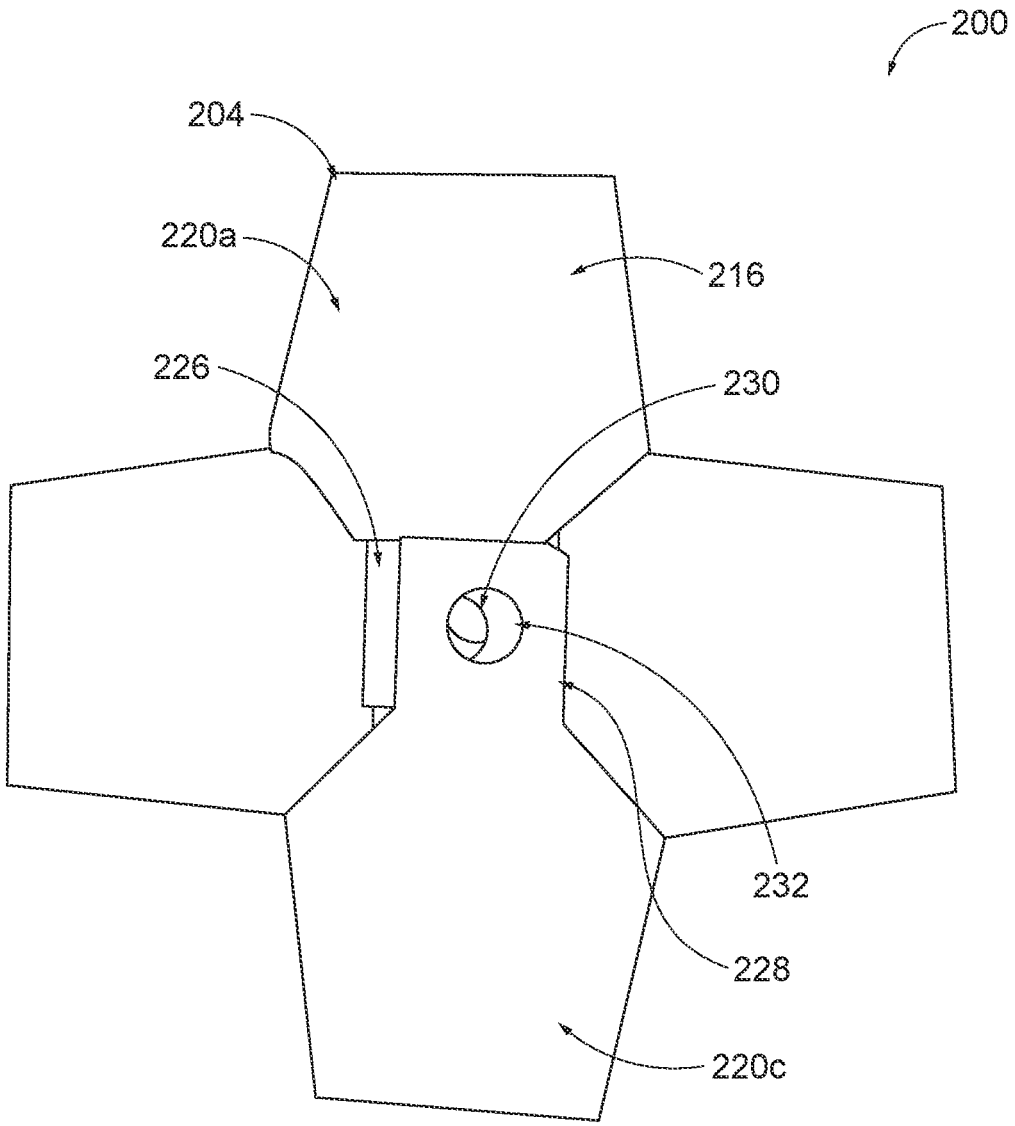
FIG. 8 illustrates a side view the spool shown in FIG. 7.
Figure 9:
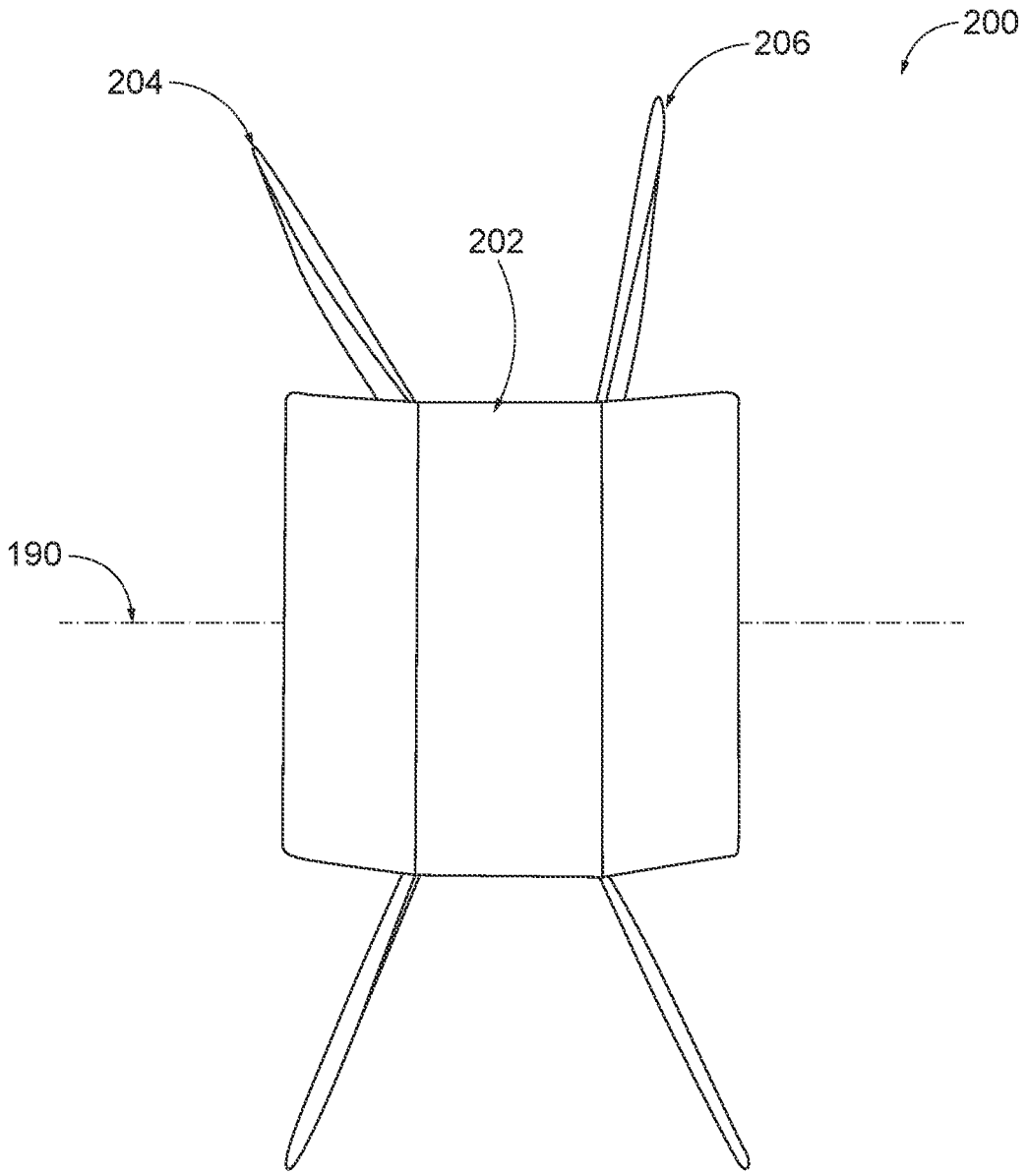
FIG. 9 illustrates a top view of the spool shown in FIG. 7.
Figure 10:
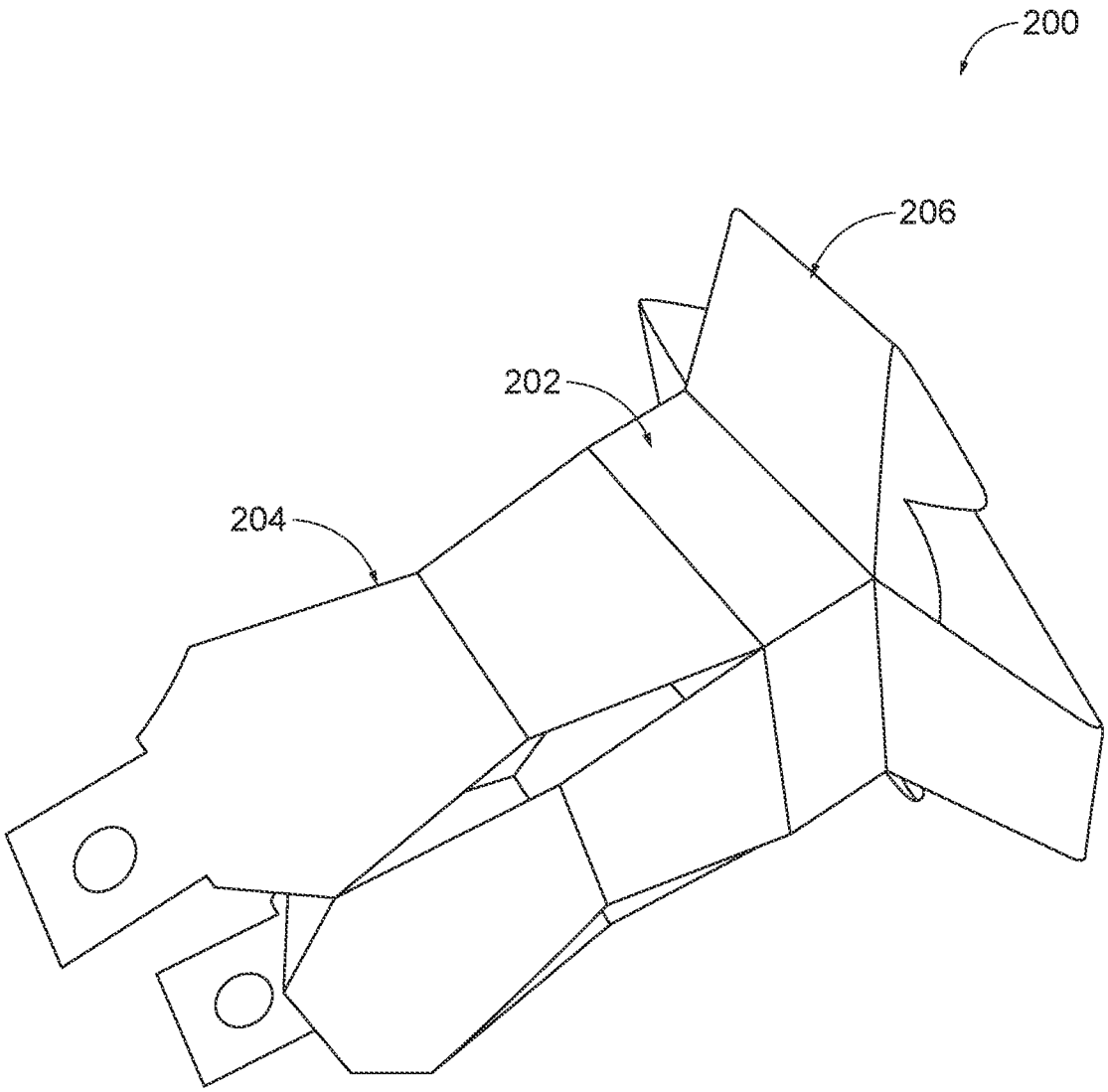
FIG. 10 illustrates a top perspective view of the spool shown in FIG. 7 in an open configuration.
Figure 11:
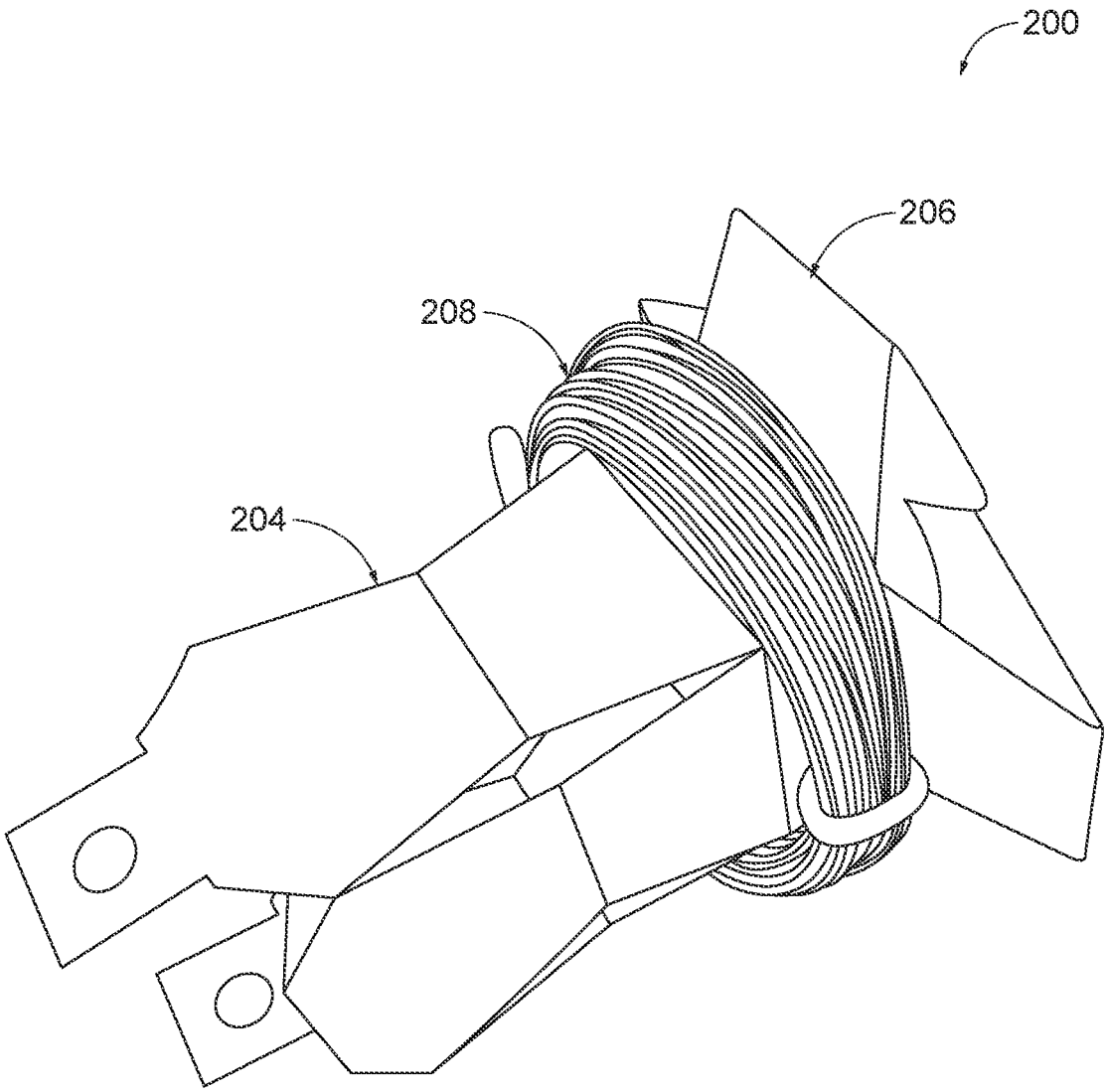
FIG. 11 illustrates a top perspective view of the spool shown in FIG. 7 in an open configuration with a roll of material positioned thereon.
Figure 12:
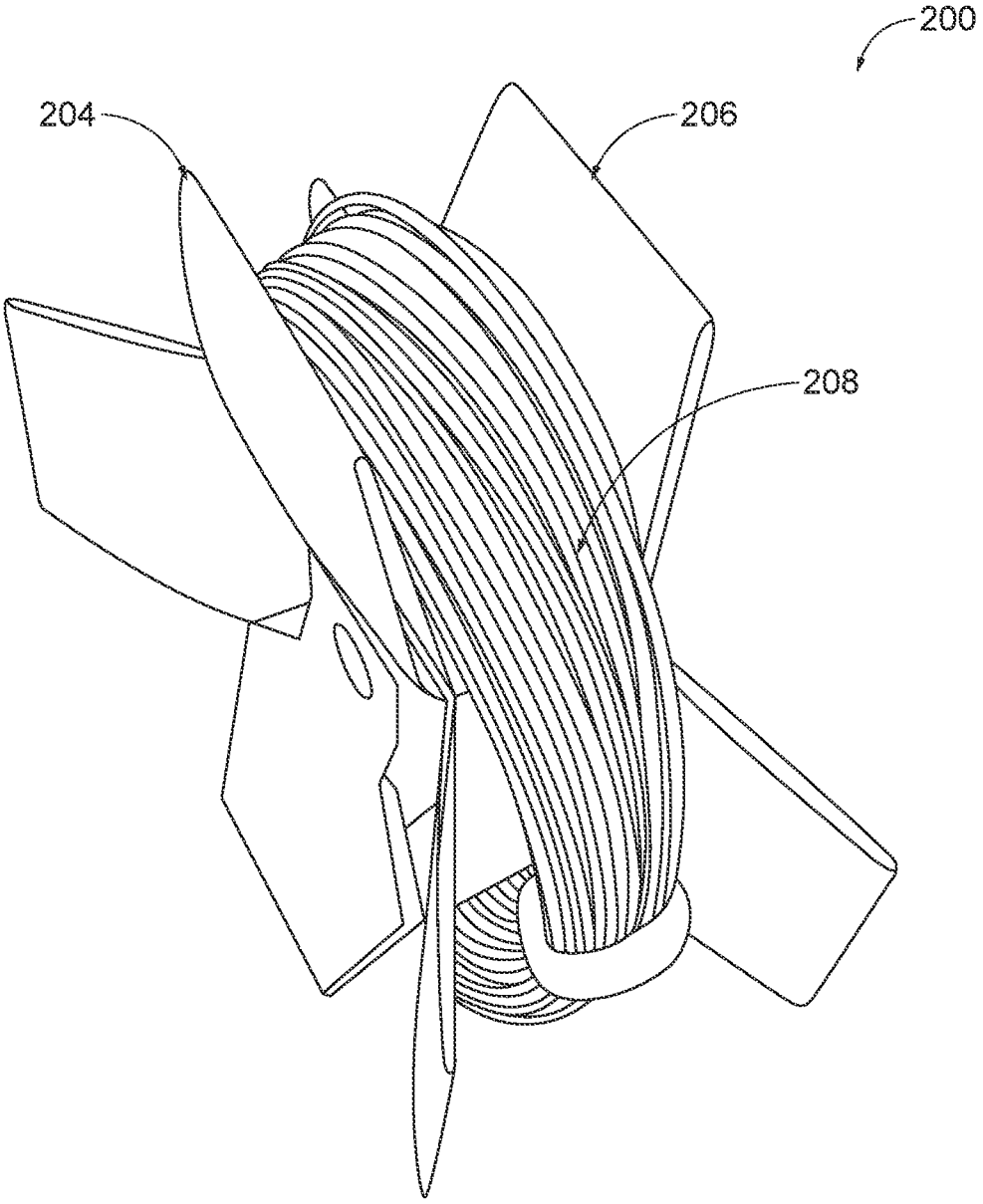
FIG. 12 illustrates a top perspective view of the spool shown in FIG. 7 in a retention configuration with a roll of material positioned thereon.
Figure 13:
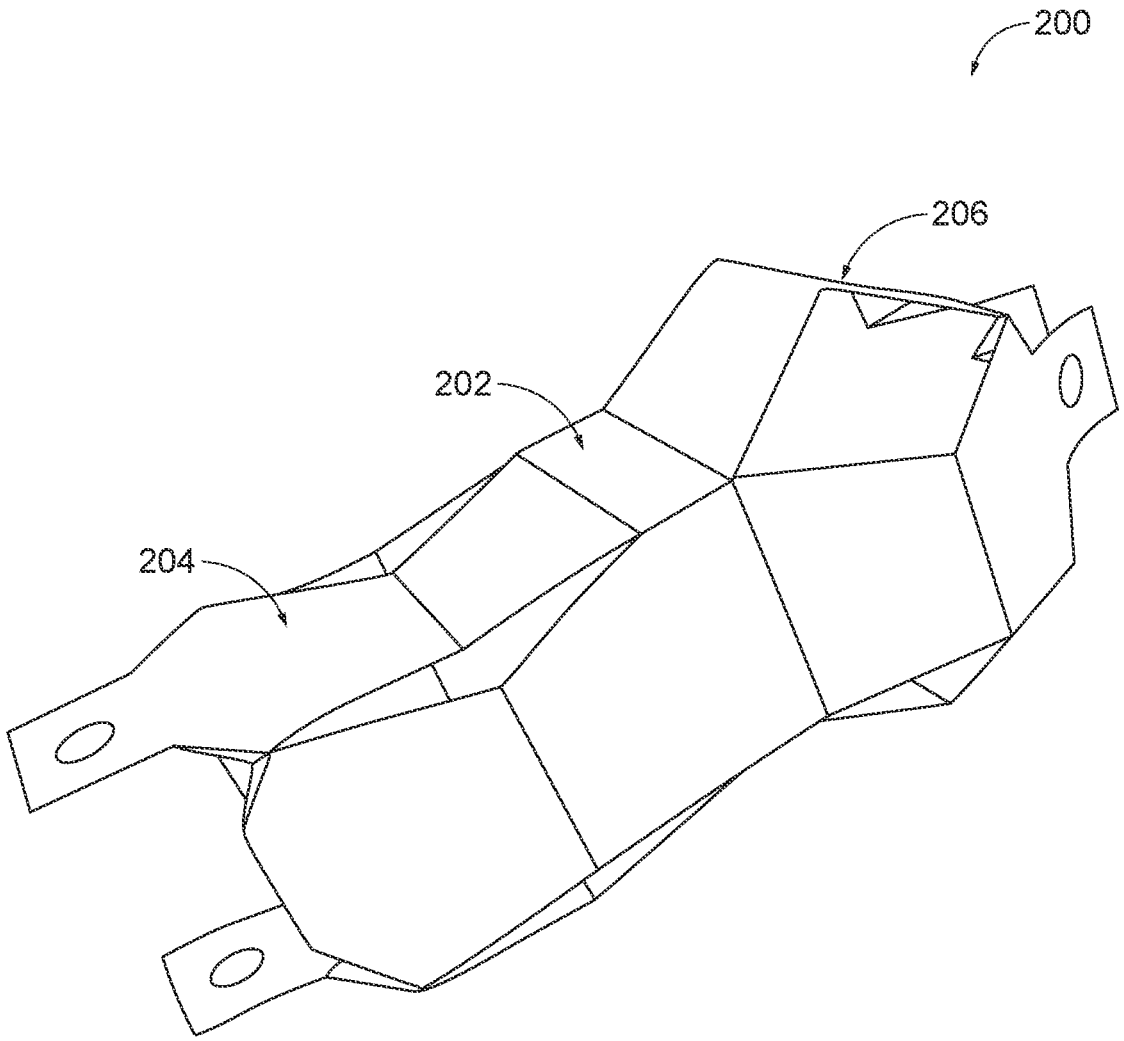
FIG. 13 illustrates a top perspective view of the spool shown in FIG. 7 in an open configuration.
Figure 14:
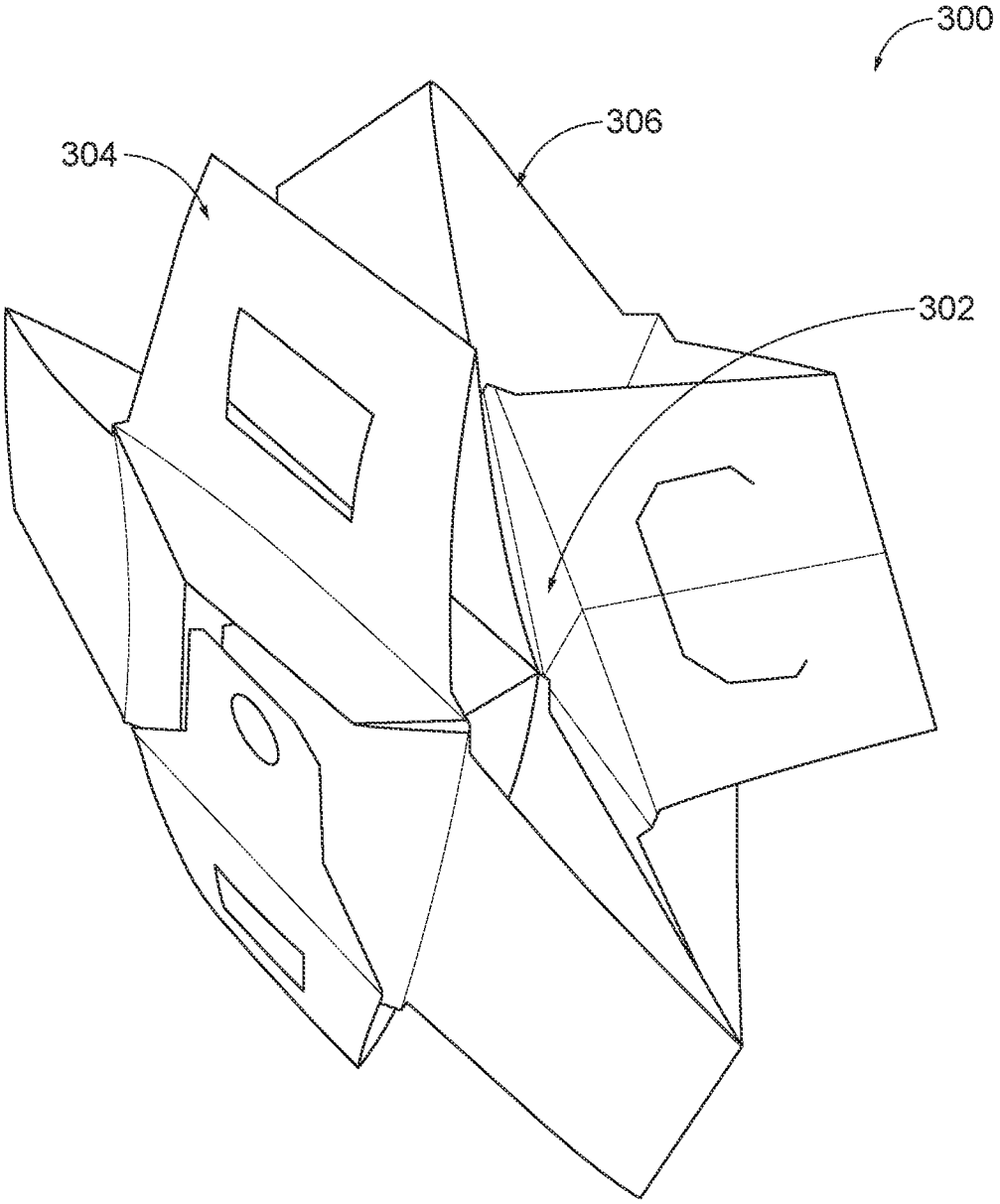
FIG. 14 illustrates a top perspective view of a spool, according to another aspect of this disclosure.
Figure 15:
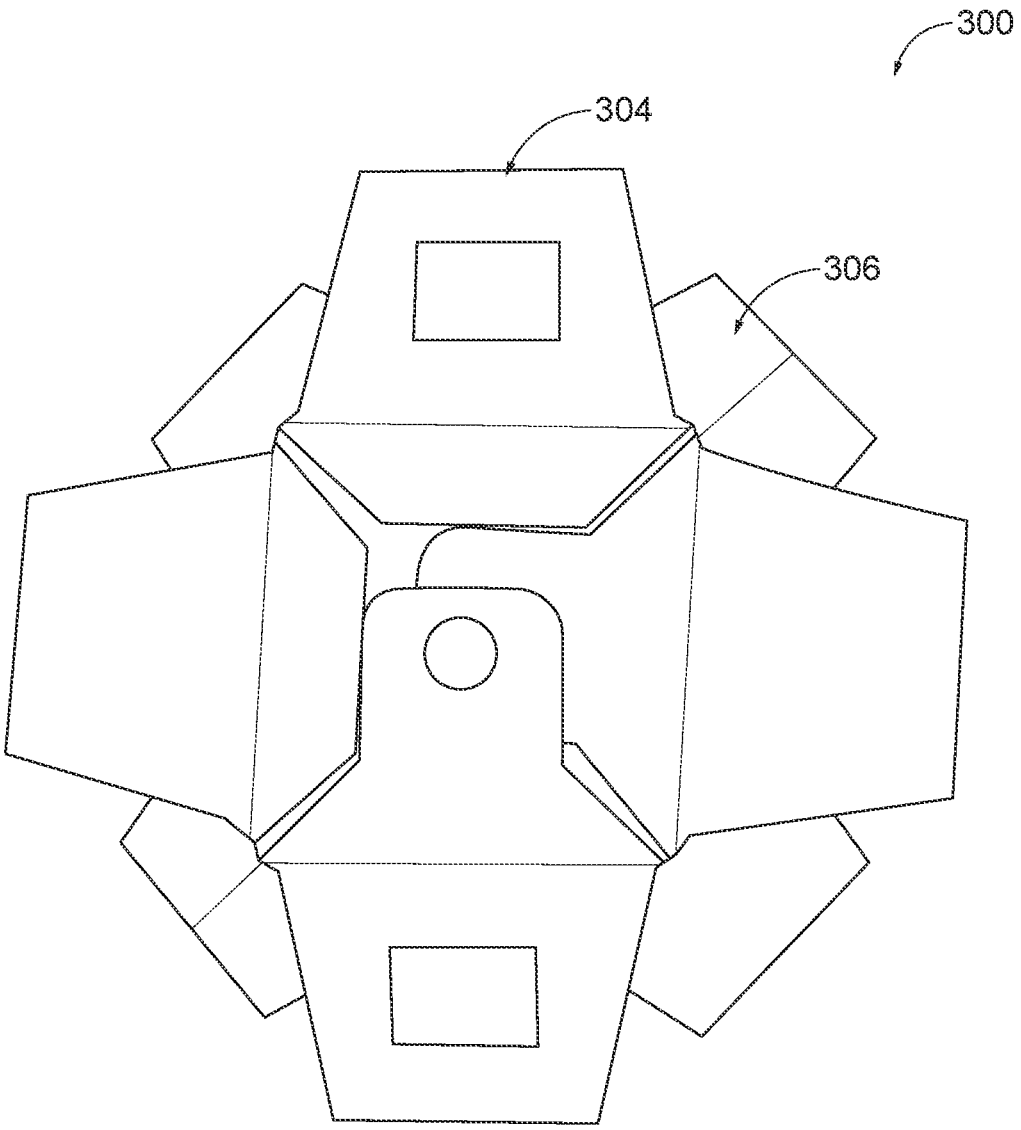
FIG. 15 illustrates a side view the spool shown in FIG. 14.
Figure 16:
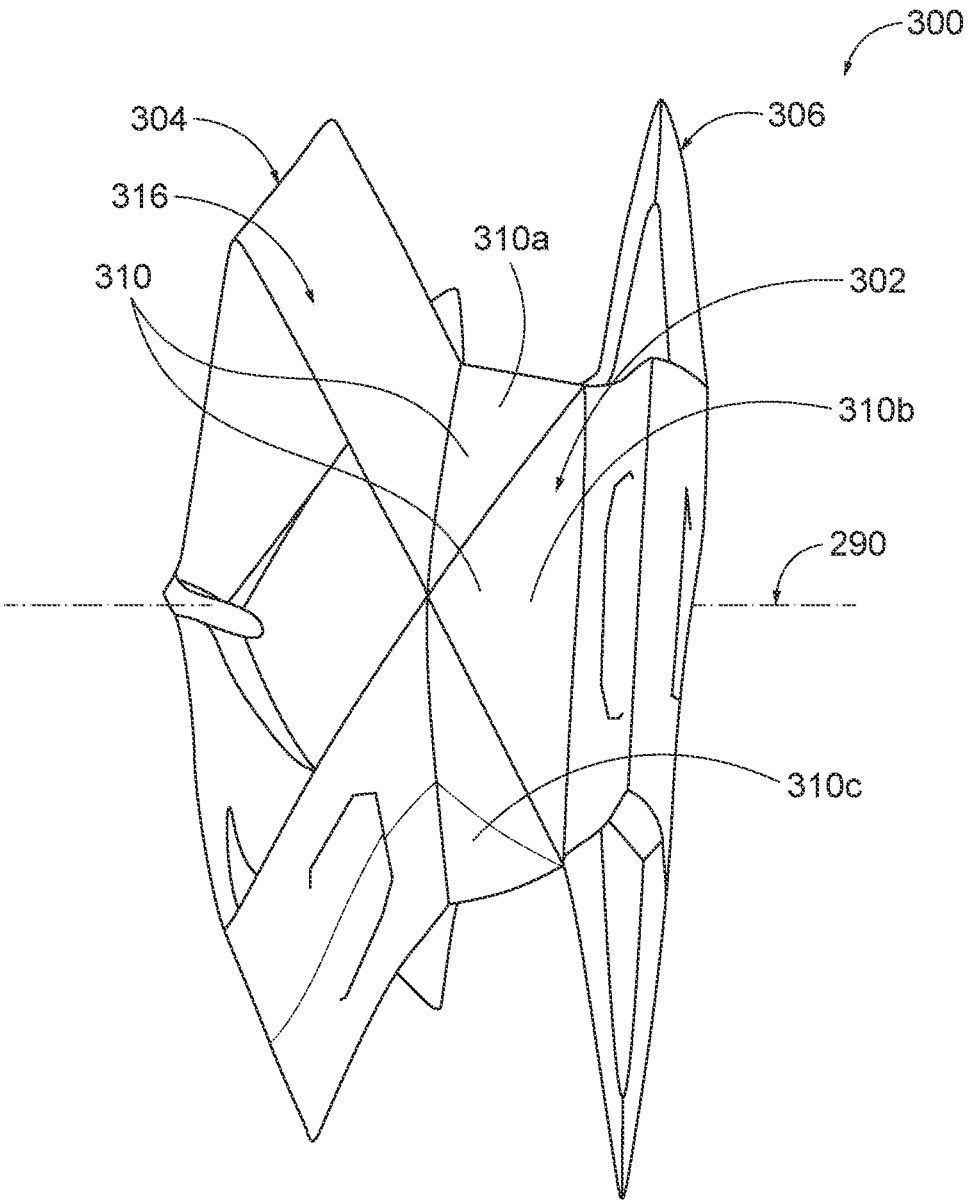
FIG. 16 illustrates a top view of the spool shown in FIG. 14.
Figure 17:
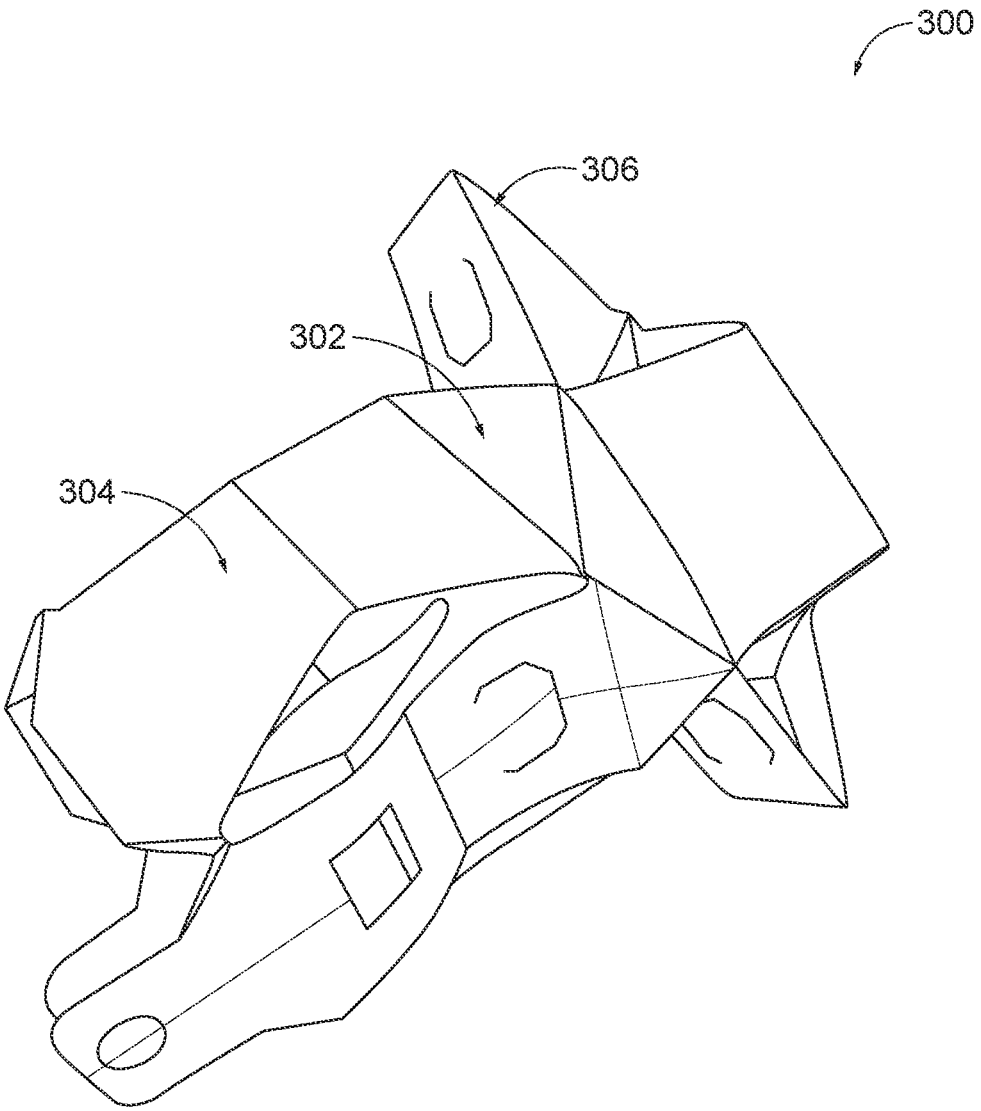
FIG. 17 illustrates a top perspective view of the spool shown in FIG. 14 in an open configuration.
Figure 18:
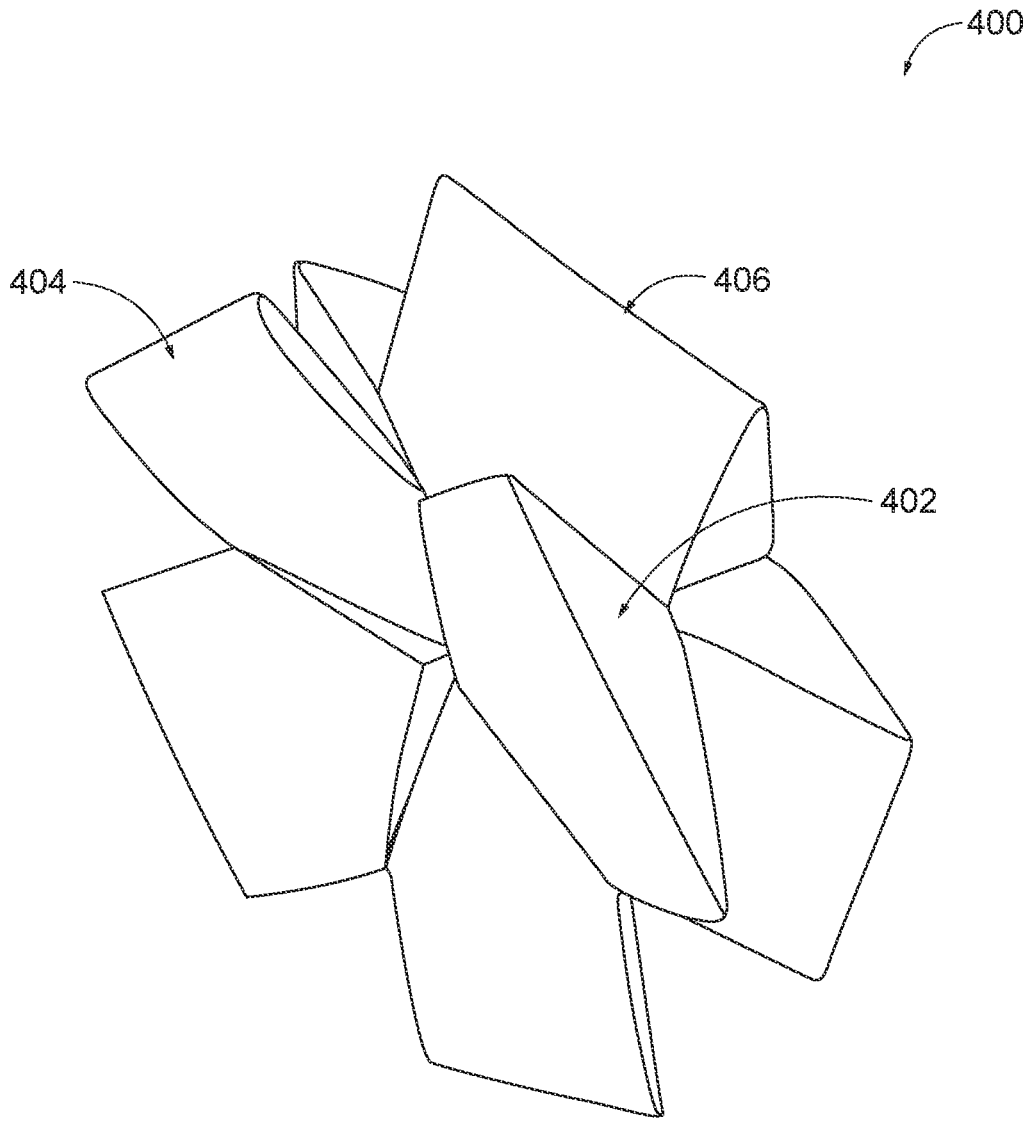
FIG. 18 illustrates a top perspective view of a spool, according to another aspect of this disclosure.
Figure 19:
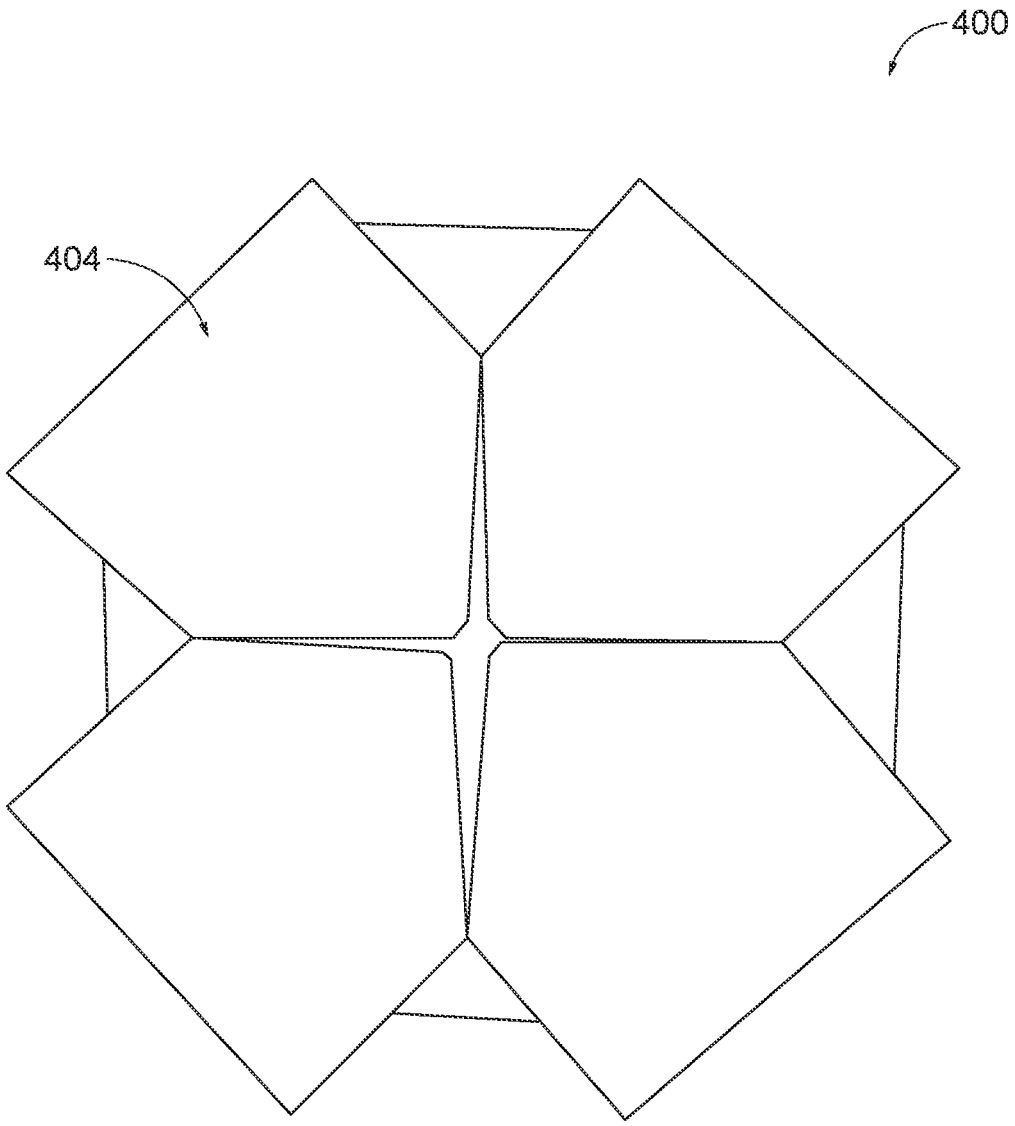
FIG. 19 illustrates a side view the spool shown in FIG. 18.
Figure 20:
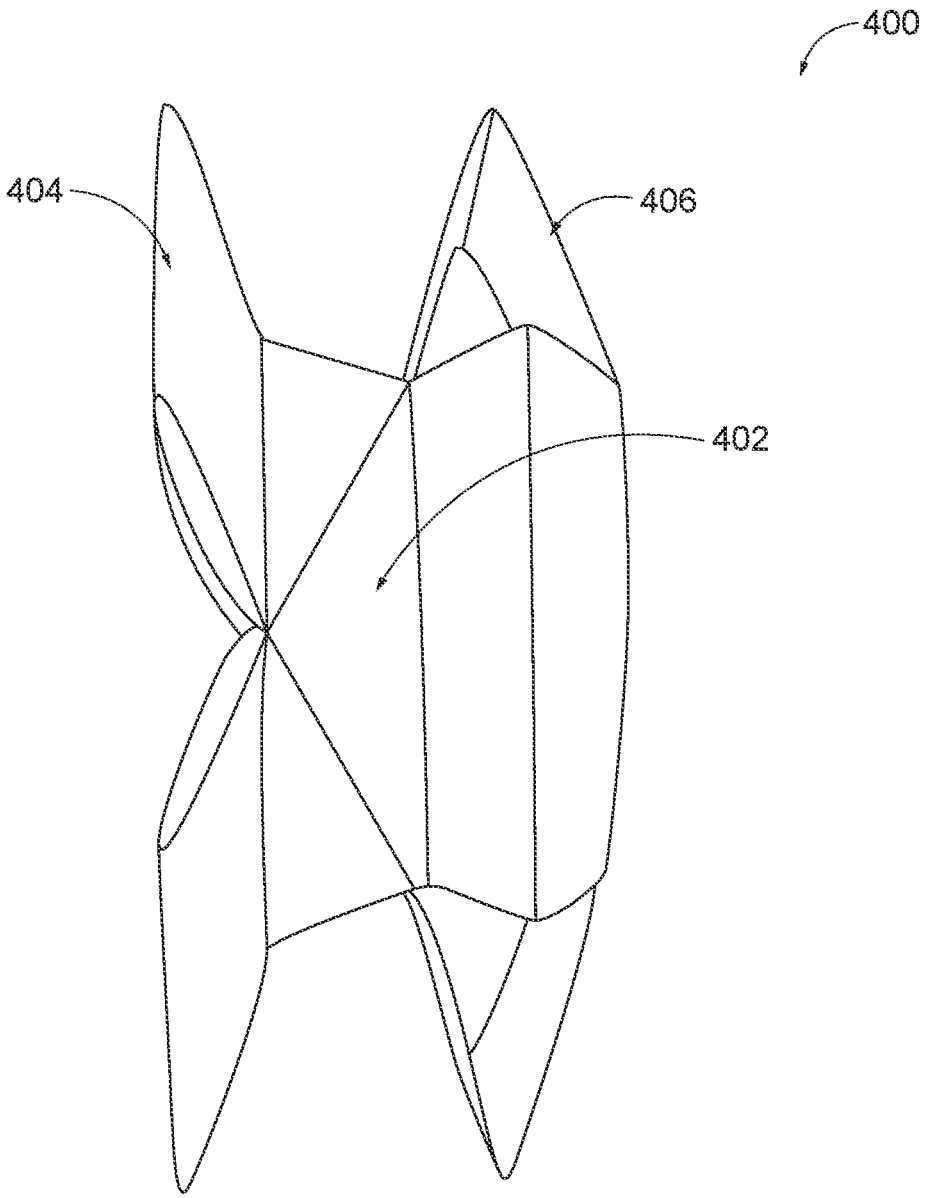
FIG. 20 illustrates a top view of the spool shown in FIG. 18.
Figure 21:
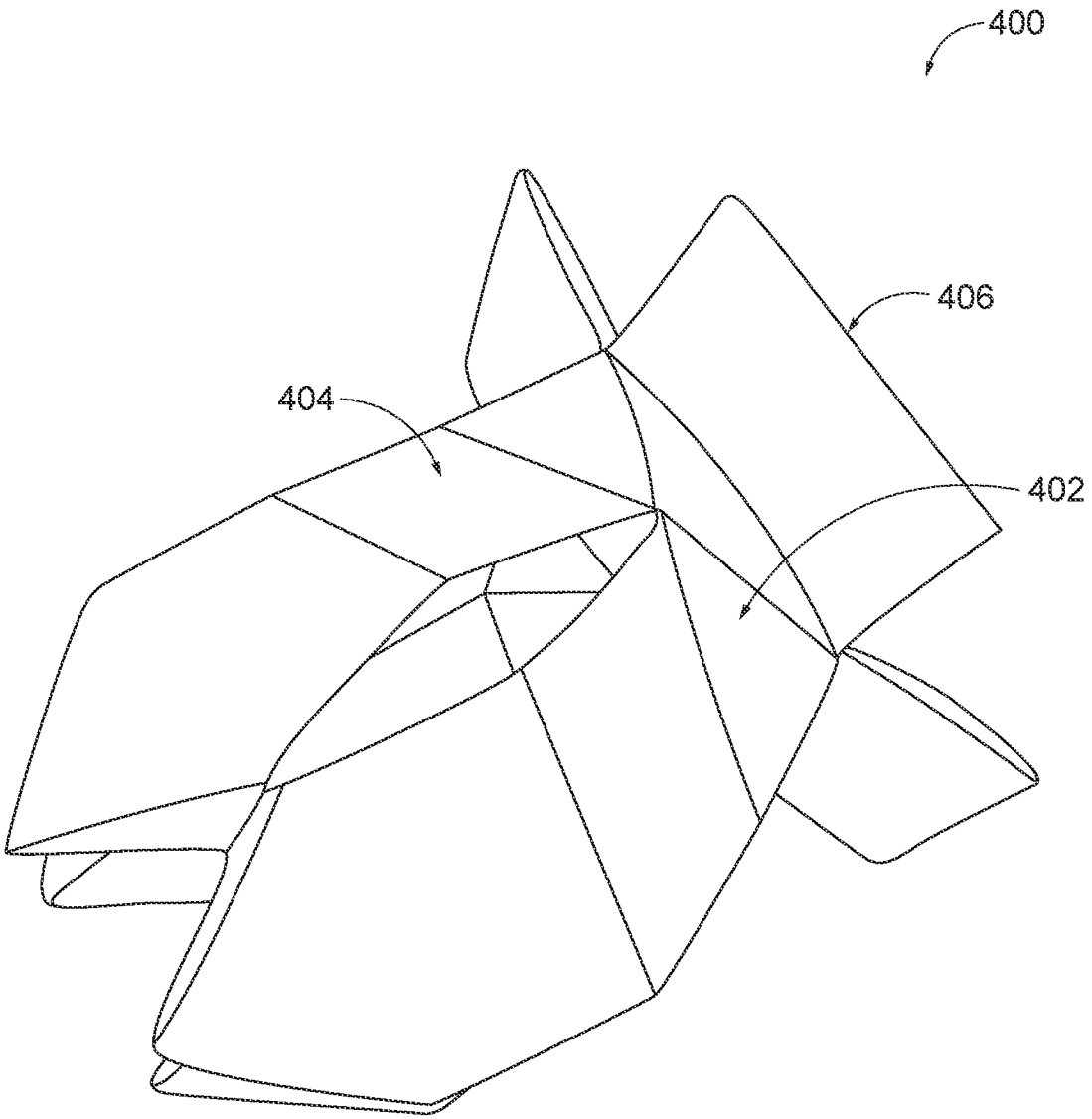
FIG. 21 illustrates a top perspective view of the spool shown in FIG. 18 in an open configuration.

With reference to FIGS. 8 through 10, a first outer panel 120*a* of a plurality of first flange panels 216 includes a first connect element 226. The first connect element 226 defines a first aperture 230 that extends therethrough. A third outer panel 120*c* of the plurality of the first flange panels 216 includes a second connect element 228 that defines a second aperture 232 that extends therethrough. In the retention configuration of the first flange 204, the first aperture 230 can substantially align with the second aperture 232 along an arbor axis 190. In an aspect, the spool 200 can include a dowel member (not shown). The dowel member can be configured to extend through the arbor 202, the first aperture 230, and the second aperture 232 along the arbor axis 190 when the first flange 204 is in the retention configuration. In an aspect, the second flange 206 can be configured substantially similarly to the first flange 204. The dowel member can further extend through first and second apertures (not shown) of the second flange 206. The dowel member can allow the spool to rotate about the arbor axis 190 such that a roll of material 208 can be wound about the arbor 202 by rotating the spool 200 about the arbor axis 190 in a coil direction. Similarly, the roll of material 208 can be unwound from the arbor 202 by rotating the spool 200 about the arbor axis 190 in a direction opposite the coil direction.

FIGS. 14 through 17 illustrate a spool 300, according to an alternative aspect of this disclosure. It will be appreciated that the spool 300 can be transitioned, aligned, and configured in a substantially similar manner as either of the spools 100 and 200 described herein. The spool 300 includes an arbor 302, a first flange 304, and a second flange 306.

The arbor 302 includes a plurality of arbor panels 310. Each of the arbor panels 310 includes a substantially triangular shape. Each of the arbor panels 310 is connected to each adjacent arbor panel 310 in series about an arbor axis 290. In an aspect, every other arbor panel 310 spaced about the arbor axis 290 includes a first arbor edge connected to the first flange 304. Each of the other every other arbor panels 310 spaced about the arbor axis 290 includes a second arbor edge that is connected to the second flange 306. For example, a first arbor panel 310*a* and a third arbor panel 310*c* of the plurality of arbor panels 310 each include a first arbor edge. The first arbor edge of both the first and third arbor panels 310*a* and 310*c* is rotatably connected to a respective flange panel of a plurality of flange panels 316. A second arbor panel 310*b* of the plurality of arbor panels 310 is positioned circumferentially between the first and third arbor panels 310*a* and 310*c*. The second arbor panel 310*b* includes a second arbor edge that is connected to the second flange 306. The configuration of the plurality of arbor panels 310 can circumferentially offset the first flange 304 from the second flange 306 when viewed along the arbor axis 290 (see FIG. 15).

FIGS. 18 through 21 illustrate a spool 400, according to an alternative aspect of this disclosure. It will be appreciated that the spool 400 can be transitioned, aligned, and configured in a substantially similar manner as any of the spools 100, 200, and 300 described herein. The spool 400 includes an arbor 402, a first flange 404, and a second flange 406 constructed of a single piece of paperboard material.

Figure 22:
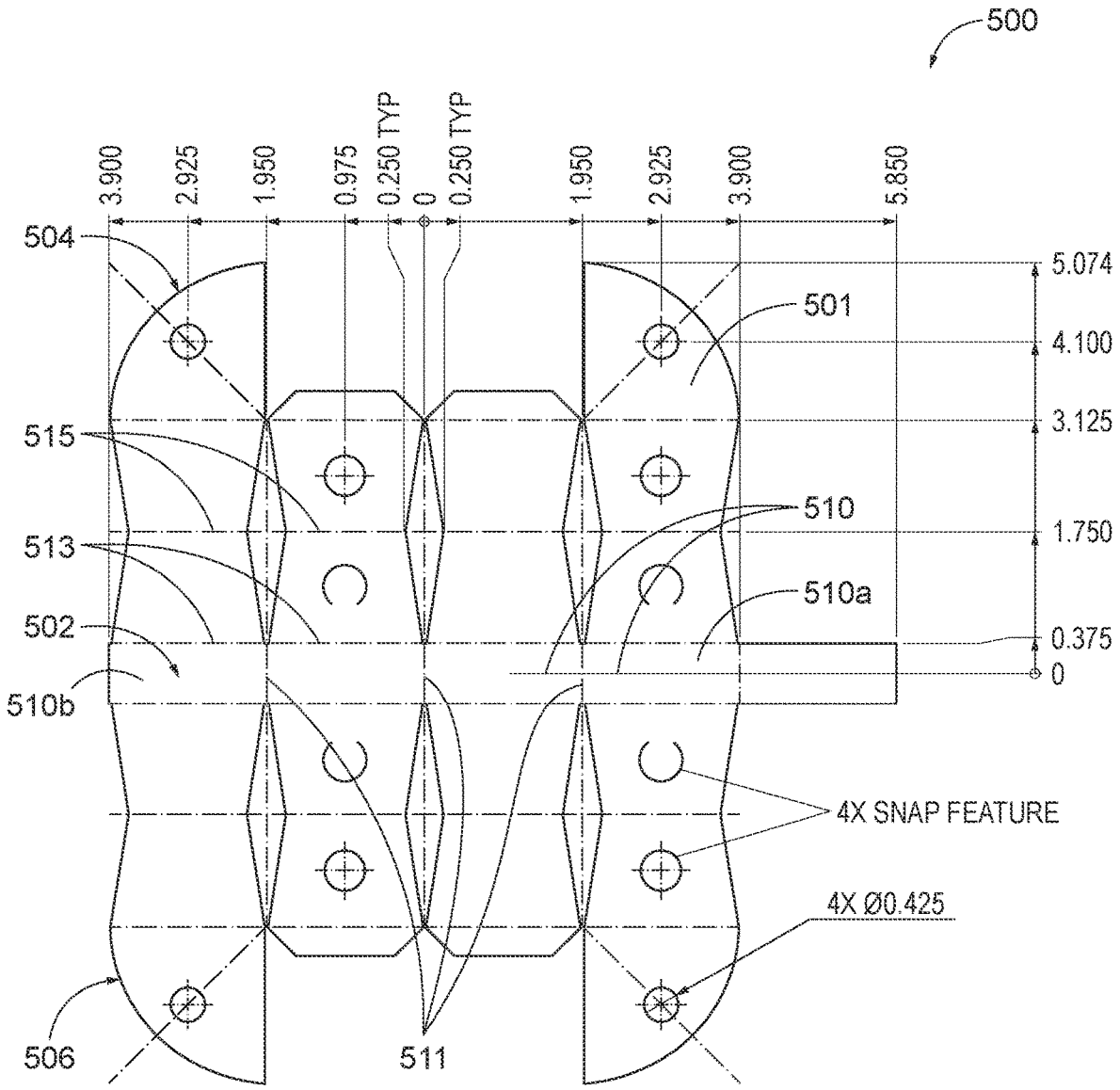
FIG. 22 illustrates a top view of a spool in an unassembled configuration, according to an aspect of this disclosure.

FIG. 22 illustrates a top view of a spool 500 in an unassembled configuration, according to an aspect of this disclosure. It will be appreciated that the spool 500 can be transitioned, aligned, and configured in a substantially similar manner as any of the spools 100, 200, 300, and 400 described herein. The spool 500 comprises a one-piece paperboard blank 501. The blank 501 can be assembled to form an arbor 502, a first flange 504, and a second flange 506.

The method of assembling the spool 500 includes forming crease lines 511 in the blank 501 between each of the plurality of arbor panels 510. Each of the crease lines 511 can allow each arbor panel 510 to rotate relative to an adjacent arbor panel 510. Crease lines 513 can be formed between each of the plurality of arbor panels 510 and respective inner flange panels of a plurality of inner flange panels 518. Each of the crease lines 513 can allow each of the plurality of inner flange panels 518 to rotate relative to a respective one of the plurality of arbor panels 510. Crease lines 515 can be formed between each of the plurality of inner flange panels 518 and respective outer flange panels of a plurality of outer flange panels 520. Each of the crease lines 515 can allow each of the plurality of outer flange panels 520 to rotate relative to a respective one of the plurality of inner flange panels 518. A crease line (see e.g. crease line 124 in FIG. 2) can be formed between adjacent outer flange panels 520 to allow adjacent outer flange panels 520 to rotate relative to each other. After the crease lines are formed in the blank 501, a first arbor panel 510*a* of a plurality of arbor panels 510 can be connected to a second arbor panel 510*b* of the plurality of arbor panels 510. After connecting the first arbor panel 510*a* to the second arbor panel 510*b*, the spool 500 is transitionable between the open configuration and the retention configuration.

Figure 27:
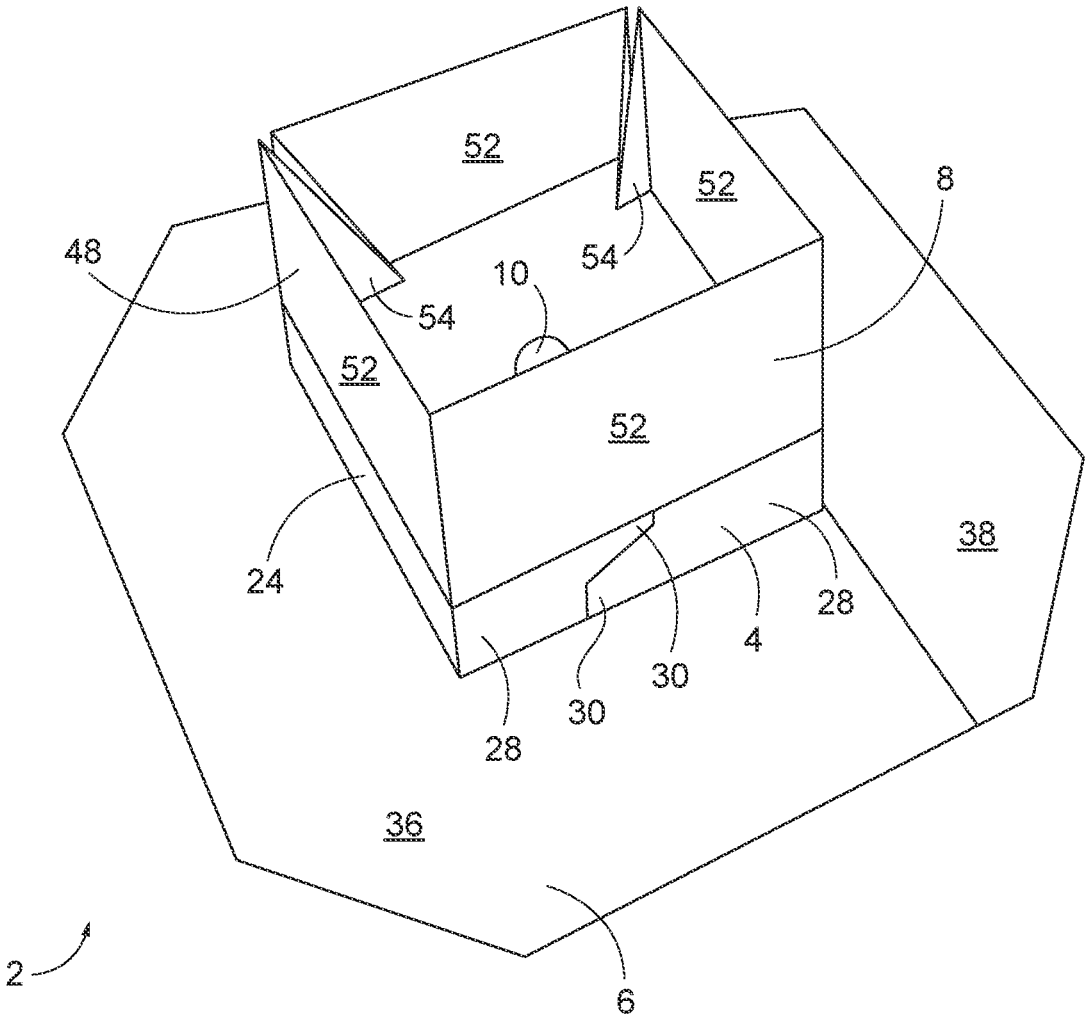
FIG. 27 illustrates a perspective view of the spool shown in FIG. 25 in a collapsed condition.

FIGS. 23-27 illustrate a spool 2, according to another alternative aspect of this disclosure. Spool 2 generally includes a barrel 4 (e.g. an arbor), a fixed flange 6, and a collapsible flange 8. Collapsible flange 8 can be configured in a collapsed condition as shown in FIG. 27 which allows a coiled item to be slid over flange 8 onto barrel 4. The coiled item can be a coil of thread, cord, wire, rope, or line. Fishing line such as fly fishing line can be stored on spool 2. Spool 2 defines a central opening 10 that allows it be rotatable mounted or stored on a hanger. In an alternative aspect, the spool 2 can include multiple collapsible flanges. For example, both of the fixed flange 6 and the collapsible flange 8 can be configured to transition to a collapsed condition to receive a coiled item to be slid over the respective flange.

Figure 23:
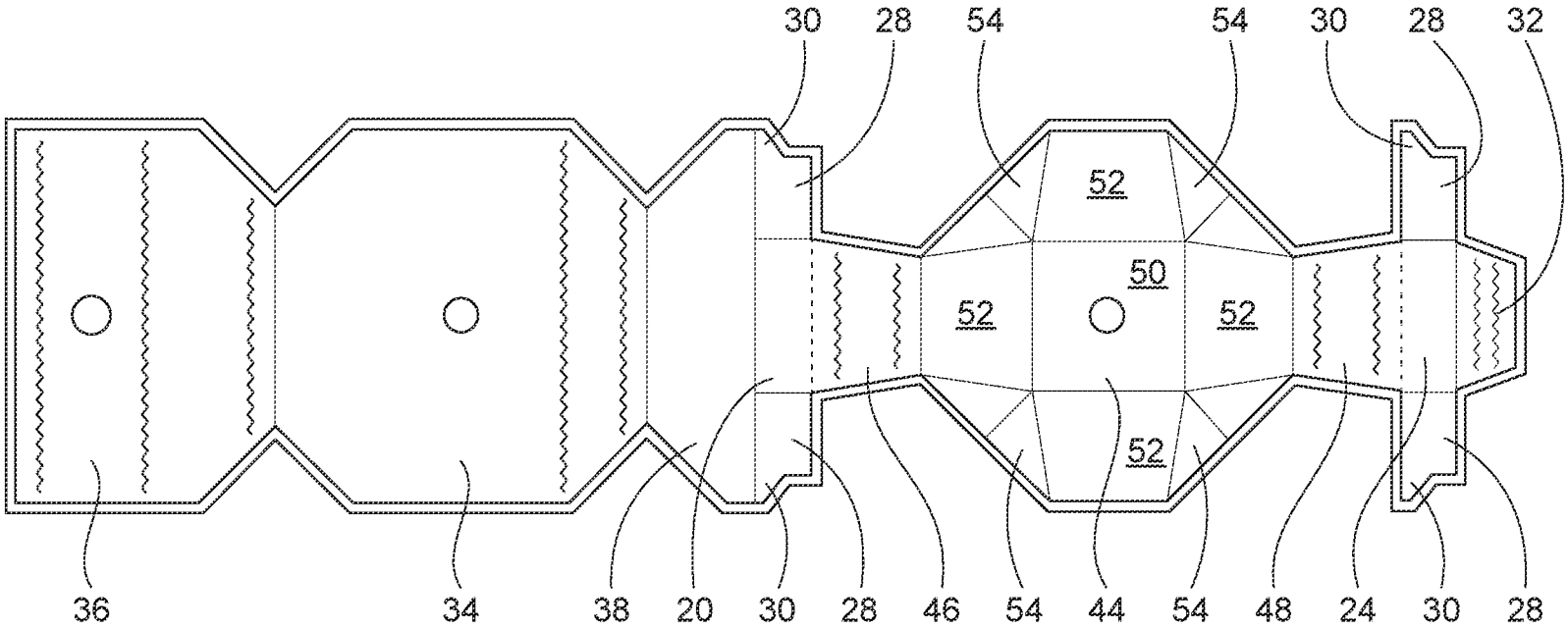
FIG. 23 illustrates a plan view of a spool blank, according to an aspect of this disclosure.
Figure 24:
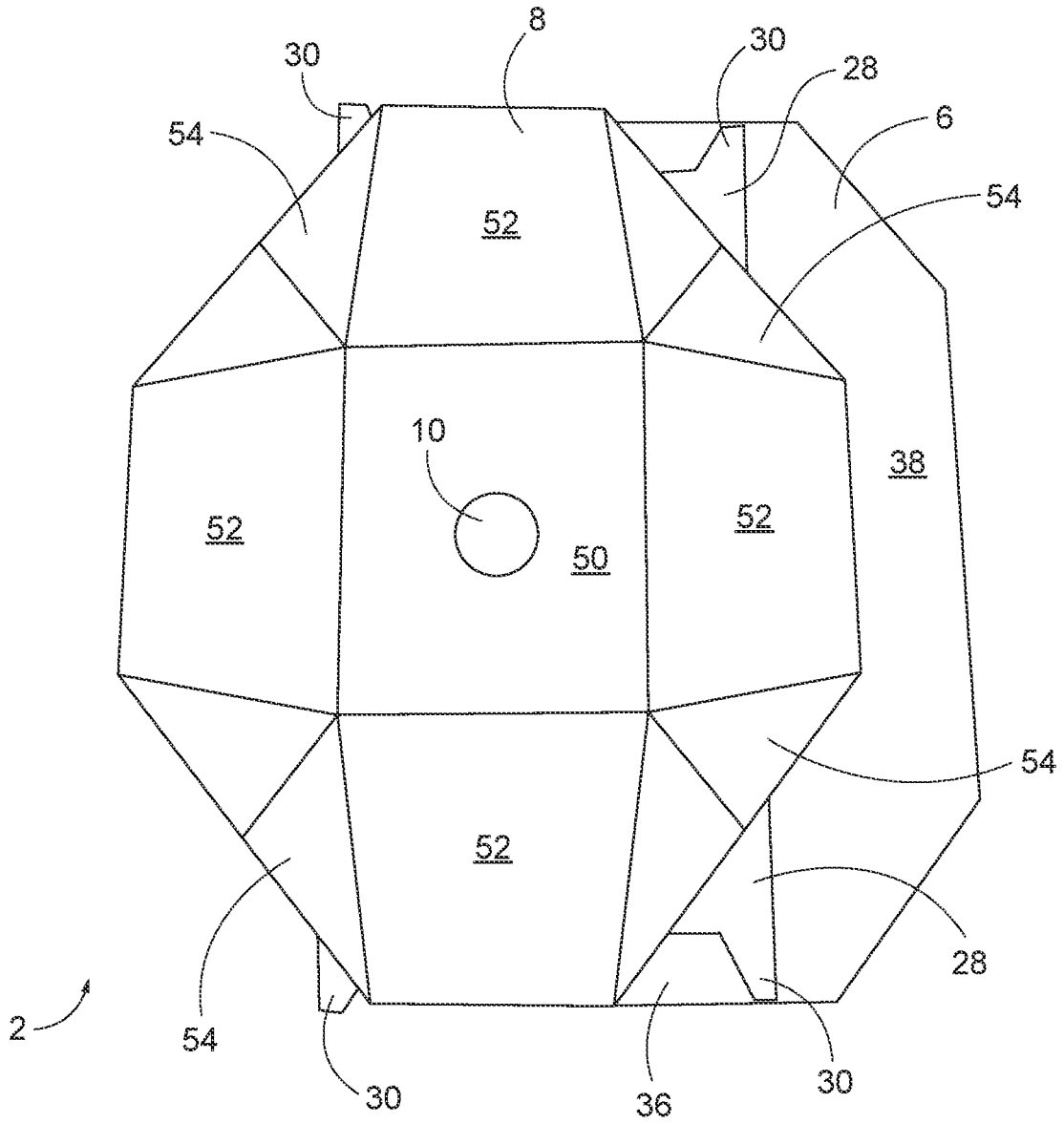
FIG. 24 illustrates a top view of the spool shown in FIG. 23 in a substantially flat intermediate position.
Figure 25:
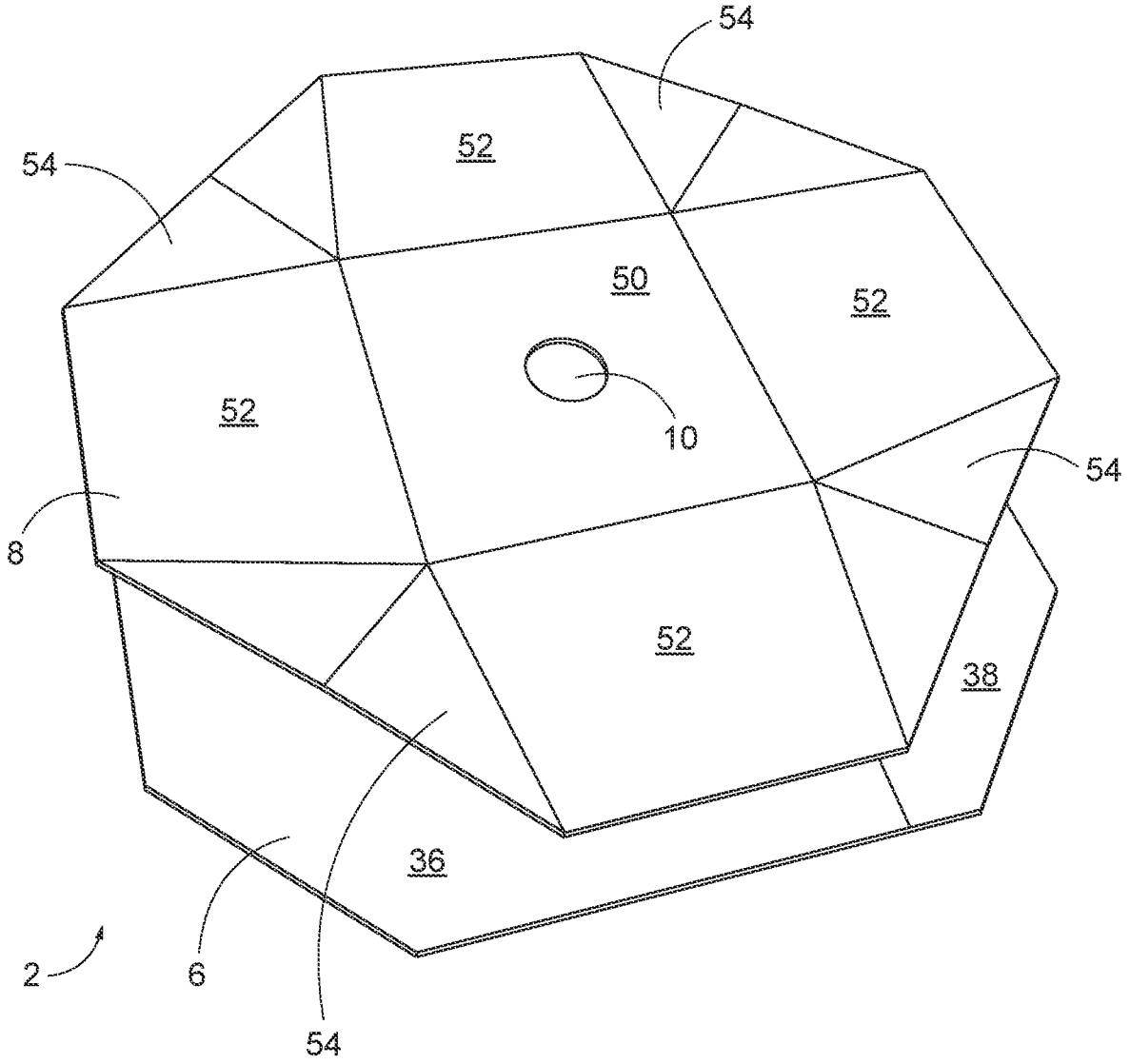
FIG. 25 illustrates a perspective view of the spool shown in FIG. 23 in an erected condition.
Figure 26:
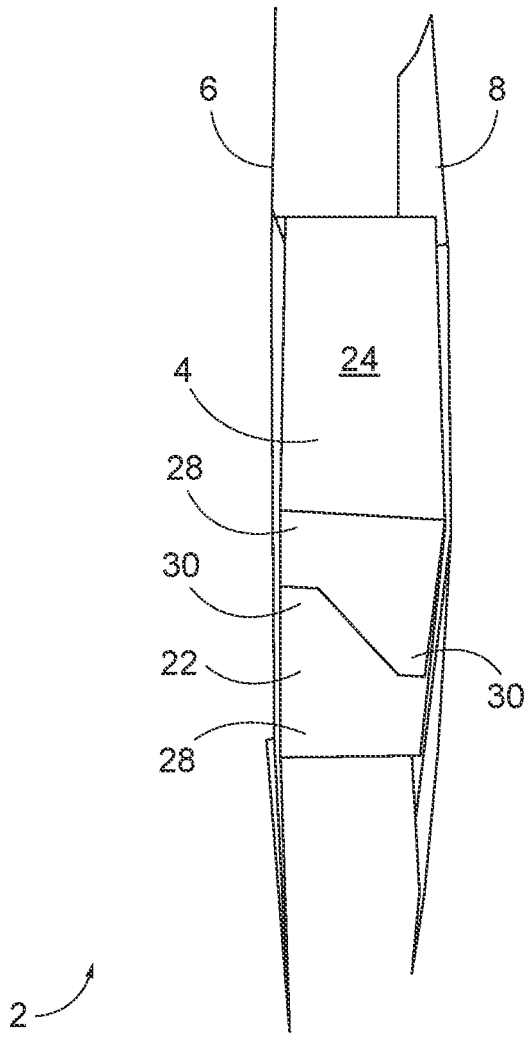
FIG. 26 illustrates a side view of the spool shown in FIG. 25.

Spool 2 can be folded into the intermediate condition of FIG. 24 and then the erected position of FIGS. 25-28 from the flat condition of FIG. 23. The flat condition of FIG. 23 can be cut from a flat piece of material such as a paper, a paperboard, or a polymer board. In the exemplary configuration, the foldable material is a 0.018 Solid Bleached Sulphate (SBS) paperboard. The locations where the material is folded can be scored, cut through, or indented. Adhesive is used to hold portions together as marked with wavy lines in FIG. 23 and as marked. It will be appreciated that the spool 2 can be held together in other ways than adhesive (e.g. snap-fits, interference fits, mechanical interlocking, etc.). Spool 2 can be made from a recyclable paper or polymer material. In other configurations, the elements of spool 2 can be formed separated and joined.

Spool 2 can be erected from the flat condition shown in FIG. 23 into an intermediate condition of FIG. 24 wherein all of the connections (e.g. adhesive connections) have been made but barrel 4 has not been completed. In this condition, the walls that used to form barrel 4 are disposed as two parallel members that allows collapsible flange 8 to pivot down until portions of its inner surface engage portions of the inner surface of fixed flange 6. In this condition, spool 2 is substantially flat which is desired for storage and shipping. From this intermediate condition, the user finishes the erection of spool 2 by pivoting collapsible flange 8 up away from fixed flange 6 until the walls that are used to form barrel 4 are substantially perpendicular to flanges 6 and 8. The barrel half walls are folded toward each other and their ends are interlocked to complete the erection of spool 2.

Once in the erected condition, spool 2 can be loaded with a coiled item either by winding the item around barrel or by sliding the coiled item over collapsible flange 8. Some coiled items such as fly fishing line are coiled during manufacturing and it is not desirable to uncoil the line from its condition and rewind it onto barrel 4. As such, collapsible flange 8 can be changed to its collapsed condition shown in FIG. 27, which allows the coiled item to be slid over collapsed flange 8 and onto barrel 4. When in the collapsed condition, flange 8 has a cross section (taken perpendicular to the axis of rotation of spool 2) that less than or equal to the cross section of barrel 4. Collapsed flange 8 may be tapered down along its length to provide for easy loading of coiled items. After the coiled item is loaded onto barrel 4, collapsible flange 8 is returned to the erected condition shown in FIGS. 25 and 26 to retain the coiled item on spool 2.

Barrel 4 includes four walls 20, 22, 24, and 26 with walls 22 and 26 being formed by barrel half walls 28 that have mechanically interlocking end portions 30. In some configurations, a user can optionally use adhesive to secure the interlocking end portions 30. The interlocking end portions 30 can include, for example, corresponding snap-fits, interference fits, or other corresponding connection or interlocking portions. Walls 20 and 24 and parallel and hinged at or to flanges 6 and 8. These hinges allow flange 8 and barrel 4 to pivot down to the substantially flat condition when they are in the intermediate condition.

Fixed flange 6 includes two main layers and an attachment flange 32 used to anchor barrel wall 24. Attachment flange is adhered to a portion of the inner surface of flange 6 inside barrel 4. The two main layers of flange 6 include an outer panel 34 (defining a portion of opening 10) and first 36 and second 38 inner panels which are folded against and adhered to outer panel 34. First inner panel overlaps and defines a portion of opening 10. Barrel wall 20 is connected to an inner end of second inner panel 38. Flange 6 can be octagonal.

Collapsible flange 8 includes two main layers defined by an outer panel 44 and first 46 and second 48 inner panels which are adhered to outer panel. First inner panel 46 is connected to the top of barrel wall 20 and second inner panel 48 is connected to the top of barrel wall 24.

Collapsible flange 8 can include a rectangular or square central portion 50 from which four tapered subpanels 52 extend. It will be appreciated that fewer or more subpanels 52 can extend from the central portion 50. FIGS. 23 and 24 illustrate the tapered sides of subpanels 52. The tapered sides of subpanels 52 can facilitate the insertion of the fishing line when the spool 2 is in the collapsed condition. Folding corner panels 54 connect the later edges of subpanels 52 and define a corner relief. When flange 8 is collapsed, folding corner panels 54 are folded inward as shown in FIG. 27 such that subpanels are disposed at or within the cross sectional perimeter of barrel 4. The folding corner panels can minimize tangling, bending, or other damage to the filament positioned about the barrel 4.

The spool assemblies disclosed herein can comprise a single piece paperboard spool that is eco-friendly and solves the short comings of the multiple piece spool designs.

It will be appreciated that the foregoing description provides examples of the disclosed system and method. However, it is contemplated that other implementations of the disclosure may differ in detail from the foregoing examples. For example, any of the embodiments disclosed herein can incorporate features disclosed with respect to any of the other embodiments disclosed herein. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

As one of ordinary skill in the art will readily appreciate from that processes, machines, manufacture, composition of matter, means, methods, or steps, presently existing or later to be developed that perform substantially the same function or achieve substantially the same result as the corresponding embodiments described herein may be utilized according to the present disclosure.

What is claimed is:

1. A spool for supporting a roll of material, the spool comprising:

an arbor that extends about an arbor axis, the arbor including a plurality of arbor panels connected to each other and spaced about the arbor axis, wherein first and second arbor panels of the plurality of arbor panels each include a first arbor edge, and wherein a third arbor panel of the plurality of arbor panels includes a second arbor edge, wherein the first arbor edges of the first and second arbor panels are spaced from the second arbor edge of the third panel in an arbor direction, the arbor direction being substantially parallel to the arbor axis;

a first flange that includes a first plurality of flange panels, wherein a first flange panel of the first plurality of flange panels is rotatably connected to the first arbor edge of the first arbor panel, and wherein a second flange panel of the first plurality of flange panels is rotatably connected to the first arbor edge of the second arbor panel; and a second flange connected to the second arbor edge of the third arbor panel, wherein the first flange is configured to transition between a retention configuration and an open configuration, wherein in the retention configuration, the first and second flange panels of the first plurality of flange panels extend from the respective first arbor edges to a retention height, and wherein in the open configuration, the first and second flange panels of the first plurality of flange panels extend from the respective first arbor edges to an open height, the retention height and the open height extending in a flange direction, the flange direction being substantially perpendicular to the arbor axis, and wherein the retention height is greater than the open height, wherein in the retention configuration, the roll of material is substantially prevented from removal from the arbor along the arbor axis by the first and second flanges, and wherein in the open configuration, the roll of material is removable from the arbor in the arbor direction.

2. The spool of claim 1, wherein the first, second, and third arbor panels are substantially planar, and wherein the first and second flange panels of the first plurality of flange panels are substantially planar.

3. The spool of claim 2, wherein the arbor further includes a fourth arbor panel of the plurality of arbor panels, wherein the first, second, third, and fourth arbor panels are connected to one another in series about the arbor axis forming a substantially rectangular cross-sectional shape when viewed along the arbor axis.

4. The spool of claim 2, wherein each of the first, second, and third arbor panels comprise a substantially triangular shape, wherein the third arbor panel is positioned circumferentially between the first and second arbor panels, wherein the third arbor panel further includes a first inner edge and a second inner edge, wherein the first inner edge is connected to the first arbor panel and the second inner edge is connected to the second arbor panel.

5. The spool of claim 1, wherein the first flange is transitionable between the retention configuration and the open configuration by rotating the first and second flange panels of the first plurality of flange panels about the respective first arbor edges of the first and second arbor panels.

6. The spool of claim 1, wherein the spool comprises a paperboard material.

7. The spool of claim 6, wherein the rotatable connection between the first flange panel of the first plurality of flange panels and the first arbor edge of the first arbor panel comprises a crease line in the paperboard material, and wherein the rotatable connection between the second flange panel of the first plurality of flange panels and the first arbor edge of the second arbor panel comprises a crease line in the paperboard material.

8. The spool of claim 1, wherein the first flange panel of the first plurality of flange panels is a first inner flange panel, and wherein the second flange panel of the first plurality of flange panels is a second inner flange panel, the spool further comprising:

a first outer flange panel of the first plurality of flange panels rotatably connected to an edge of the first inner flange panel; and a second outer flange panel of the first plurality of flange panels rotatably connected to an edge of the second inner flange panel, wherein the first outer flange panel is rotatably connected to the second outer flange panel.

9. The spool of claim 8, wherein in the retention configuration of the first flange, 1.) a surface of the first outer flange panel abuts against a surface of the first inner flange panel, 2.) a surface of the second outer flange panel abuts against a surface of the second inner flange panel, and 3.) the rotatable connection between the first outer flange panel and the second outer flange panel extends along a line at an angle of approximately 45 degrees relative to the first arbor edge.

10. The spool of claim 8, wherein the arbor further includes a fourth arbor panel of the plurality of arbor panels, wherein the first, second, third, and fourth arbor panels are connected to one another in series about the arbor axis, wherein the spool further comprises:

a third inner flange panel of the first plurality of flange panels rotatably connected to a first arbor edge of the third arbor panel;

a fourth inner flange panel of the first plurality of flange panels rotatably connected to a first arbor edge of the fourth arbor panel;

a third outer flange panel of the first plurality of flange panels rotatably connected to an edge of the third inner flange panel; and a fourth outer flange panel of the first plurality of flange panels rotatably connected to an edge of the fourth inner flange panel, wherein the third outer flange panel is rotatably connected to the fourth outer flange panel.

11. The spool of claim 10, wherein at least one of the first and second outer flange panels define a first aperture, and wherein at least one of the third and fourth outer flange panels define a second aperture, wherein in the retention configuration of the first flange the first aperture substantially aligns with the second aperture along the arbor axis.

12. The spool of claim 11, further comprising:

a dowel member configured to extend through the arbor, the first aperture, and the second aperture along the arbor axis when the first flange is in the retention configuration.

13. The spool of claim 8, wherein the first outer flange panel includes a first connect element, and wherein the second outer flange panel includes a second connect element, wherein in the retention configuration of the first flange the first connect element is configured to connect to the second connect element to selectively retain the first flange in the retention configuration.

14. The spool of claim 1, wherein the second flange includes a second plurality of flange panels, wherein a first flange panel of the second plurality of flange panels is rotatably connected to a second arbor edge of the first arbor panel, wherein a second flange panel of the second plurality of flange panels is rotatably connected to a second arbor edge of the second arbor panel, and wherein a third flange panel of the second plurality of flange panels is rotatably connected to the second arbor edge of the third arbor panel, wherein the second flange is configured to transition between a retention configuration and an open configuration, wherein in the retention configuration of the second flange, the first, second, and third flange panels of the second plurality of flange panels extend from the respective second arbor edges to the retention height, and wherein in the open configuration, the first, second, and third flange panels of the second plurality of flange panels extend from the respective second arbor edges to the open height.

15. A method of assembling a paperboard spool from a one-piece paperboard blank, the method comprising:

connecting a first arbor panel of a plurality of arbor panels to a second arbor panel of the plurality of arbor panels, wherein the first and second arbor panels form at least a portion of an arbor that extends about an arbor axis;

forming a first flange panel crease line between the first arbor panel and a first flange panel of a first plurality of flange panels such that the first flange panel is rotatable relative to the first arbor panel; and forming a second flange panel crease line between the second arbor panel and a second flange panel of the first plurality of flange panels such that the second flange panel is rotatable relative to the second arbor panel, wherein the first plurality of flange panels compose a first flange that is configured to transition between a retention configuration and an open configuration, wherein in the retention configuration, the first and second flange panels of the first plurality of flange panels extend from the respective first and second arbor edges to a retention height, and wherein in the open configuration, the first and second flange panels of the first plurality of flange panels extend from the respective first and second arbor edges to an open height, the retention height and the open height extending in a flange direction from the arbor axis, the flange direction being substantially perpendicular to the arbor axis, and wherein the retention height is greater than the open height, wherein in the retention configuration, the roll of material is substantially prevented from removal from the arbor along the arbor axis by the first flange and a second flange, the first flange being spaced from the second flange along an arbor direction that is substantially parallel to the arbor axis, and wherein in the open configuration, the roll of material is removable from the arbor along the arbor axis in the arbor direction.

16. The method of claim 15, further comprising:

forming a first arbor crease line between the second arbor panel and a third arbor panel of the plurality of arbor panels, wherein the first, second, and third arbor panels form at least a portion of the arbor.

17. The method of claim 16, further comprising:

forming a second arbor crease between the third arbor panel and a fourth arbor panel of the plurality of arbor panels, wherein the first, second, third, and fourth arbor panels form at least a portion of the arbor; and forming a third arbor crease line between the fourth arbor panel and the first arbor panel.

18. The method of claim 17, wherein the first, second, third, and fourth arbor panels extend about the arbor axis forming a substantially rectangular cross-sectional shape when viewed along the arbor axis.

19. The method of claim 15, wherein the first flange panel of the first plurality of flange panels is a first inner flange panel, and wherein the second flange panel of the first plurality of flange panels is a second inner flange panel, the method further comprising:

forming a third flange panel crease line between the first inner flange panel and a first outer flange panel of the first plurality of flange panels such that the first outer flange panel is rotatable relative to the first inner flange panel; and forming a fourth flange panel crease line between the second inner flange panel and a second outer flange panel of the first plurality of flange panels such that the second outer flange panel is rotatable relative to the second inner flange panel.

20. The method of claim 19, further comprising:

forming a fifth flange panel crease line between the first outer flange panel and the second outer flange panel such that the first outer flange panel is rotatable relative to the second outer flange panel.

* * * * *